United States Patent [19]

Interrante

[11] 4,426,858

[45] Jan. 24, 1984

[54] TAMPER DEACTIVATING ASSEMBLY

[76] Inventor: Bruno Interrante, 371 Charles Ave., Massapequa Park, N.Y. 11762

[21] Appl. No.: 269,378

[22] Filed: Jun. 1, 1981

[51] Int. Cl.[3] ..... E05B 15/00; E05B 17/00; E05B 63/00; E05C 3/16

[52] U.S. Cl. ..... 70/1.5; 70/418; 70/422; 292/225

[58] Field of Search ..... 70/1.5, 466, 1.7, 333, 70/416, 418, 422; 109/30; 292/DIG. 43, 292/DIG. 25, 214, 225

[56] References Cited

U.S. PATENT DOCUMENTS

| | | | |
|---|---|---|---|
| 2,218,683 | 10/1940 | Miller . | |
| 2,609,679 | 9/1952 | Bremer et al. | 70/1.5 |
| 3,315,502 | 4/1967 | Skrapits . | |
| 3,345,839 | 10/1967 | Brissette . | |
| 3,442,102 | 5/1969 | Butts | 70/1.5 |
| 3,529,452 | 9/1970 | Rae . | |
| 3,740,980 | 6/1973 | Schimizzi et al. . | |
| 3,760,617 | 9/1973 | Westerdale | 70/1.5 |
| 3,783,655 | 1/1974 | Giannetto | 70/1.5 |
| 3,868,836 | 3/1975 | La Roche . | |
| 3,881,330 | 5/1975 | Hester | 70/418 X |
| 3,961,504 | 6/1976 | Sprecher | 70/418 X |
| 4,220,024 | 9/1980 | Berich | 70/416 |

*Primary Examiner*—Gary L. Smith
*Assistant Examiner*—Lloyd A. Gall
*Attorney, Agent, or Firm*—Peter James Franco

[57] ABSTRACT

Tamper deactivating pivotal motion transmission assembly, e.g. between a motor vehicle deck lid exterior lock and interior latch, comprising a bearing, e.g. containing a bore concentric to an axis; an actuator mounted thereon for pivotal movement about the axis at an activating position, e.g. for releasing the latch, and for deviating movement out of operative relation with the bearing to a deactivating position, e.g. preventing latch release; an urging mechanism, e.g. a spring, urging the actuator to deactivating position; and a pivotal force transmitting shaft, preferably of curved cross section and flexible and extending through the bore, e.g. axially connected at its head end to the actuator for conjoint movement therewith relative to the bearing and having its tail end remote therefrom and arranged for attachment under tension at a remote reference point, e.g. to the lock, for maintaining the actuator at the activating position against the urging mechanism force and for receiving a pivotal force applied to the tail end, e.g. by the lock, for pivoting the shaft and actuator, e.g. to release the latch; whereby upon disturbing the tension attachment disposition of the tail end at or relative to the reference point, e.g. lock, the urging mechanism will urge the actuator to deactivating position;

preferably as a substitute assembly wherein an oversized actuator is pivoted on a tube as the bearing fixed in the bearing bore of a conventional latch instead of its usual latch release actuator arm.

21 Claims, 8 Drawing Figures

TAMPER DEACTIVATING ASSEMBLY

Figure 1:
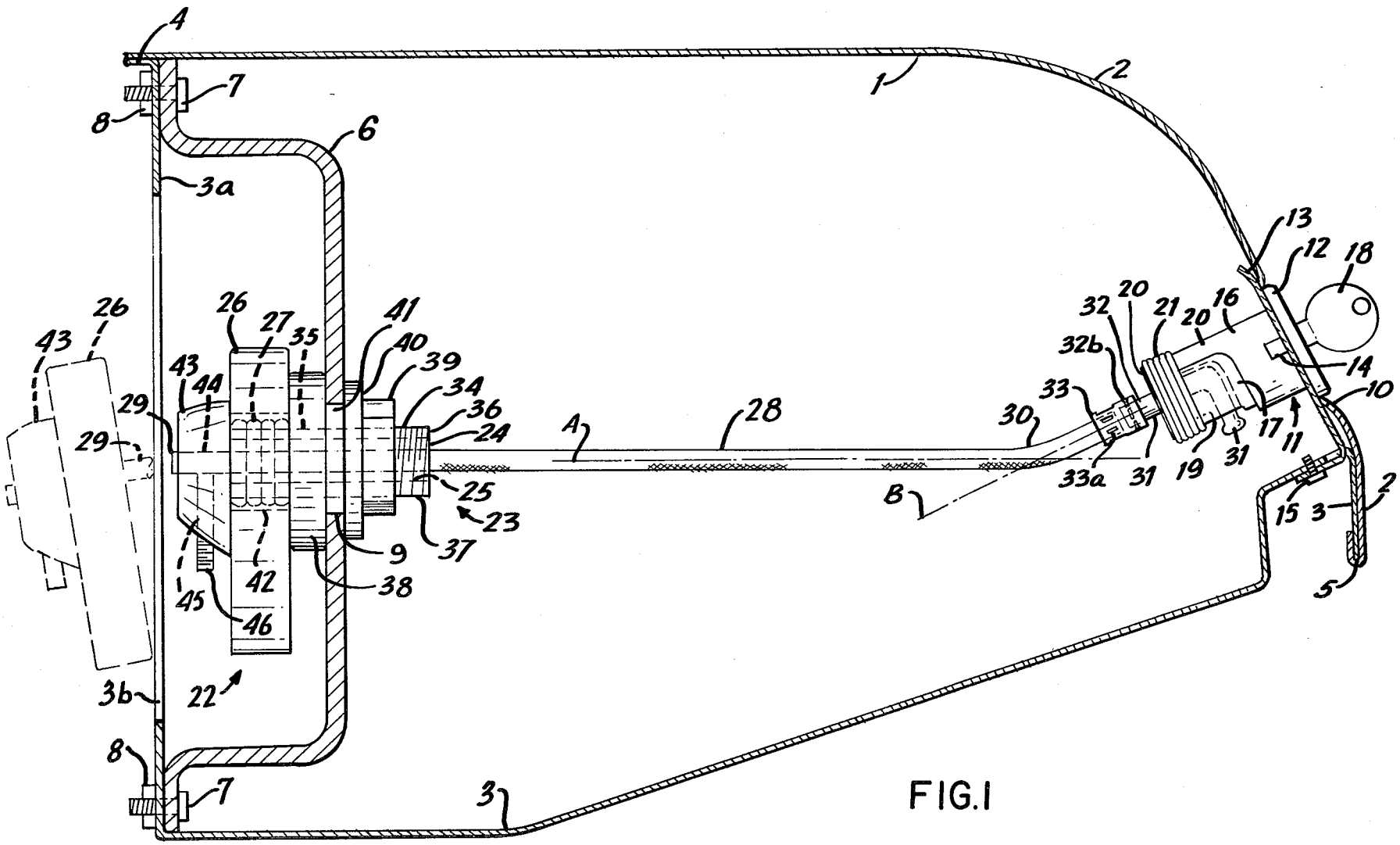

The present invention relates to a tamper deactivating pivotal motion transmission assembly, and more particularly to an assembly usable in a motor vehicle compartment lid or deck lid lock and latch arrangement to prevent unauthorized latch release, despite access thereto through the lock opening or through an opening made in the vehicle exterior wall.

The unauthorized entry of motor vehicle trunk compartments and similar lockable spaces is widespread. Because of the relatively low cost and readily penetrable construction of motor vehicle exterior walls and deck lids or trunk doors and the like, and their locks, it is a simple matter to break open the lock in the vehicle body or in the lid or door, or to pierce the relatively thin exterior wall portion adjacent thereto to spring the latch. Using a crude tool, this can be done in simple and rapid manner by anyone and with little chance of being caught.

The usual motor vehicle deck lid lock and latch arrangement, which is disposed either on the vehicle body or in the deck lid, includes a lock mechanism or key lock in a lock opening in the exterior wall and which is operated by a trunk key, and a latch mechanism or body lock at an interior wall which is inwardly spaced from the exterior wall, plus a rigid flat transmission shaft linking the rotatable lock portion of the lock mechanism with the rotatable latch release actuator arm pivotally mounted in an exposed bearing bore in the latch mechanism. Upon twisting the trunk key in the lock mechanism, the rotatable lock portion rotates the rigid flat shaft which in turn pivots the latch release actuator arm to engage a release system or lever linkage for unlatching the latch mechanism, thereby opening the deck lid or trunk door.

The transmission shaft is usually provided with a hook at its lock end to engage a seat or eye on the rear or inner end of the rotatable lock portion, whereas the latch end of the shaft is usually simply inserted slidingly removably in a slot in the exposed latch release actuator arm.

The release system or lever linkage of the latch mechanism usually includes a release arm and a locking arm arranged so that as the latch release actuator arm pivots, it comes into contact with the release arm, moving it away from the locking arm and causing the locking arm to drop down and out of contact with a striker on the vehicle body or in the deck lid, as the case may be, thus releasing the latch.

Hence, several simple break-in methods to by-pass the key lock in conventional arrangements, so as to gain unauthorized entry into the trunk or other compartment of a motor vehicle, readily suggest themselves.

First, by simply punching a screwdriver or other crude tool through the adjacent portion of the exterior wall, e.g. directly below the key lock housing, contact may be made with the rigid flat transmission shaft. A slight, e.g. clockwise, motion by the tool held against the shaft will cause the shaft to bend, distort and twist, and in turn pivot the latch release actuator arm to unlatch the latch mechanism in the normal manner, even though the lock mechanism remains stationary, thus opening the trunk lid.

Second, by using a slap-hammer or other prying tool, the key lock can be completely pulled out of its opening in the exterior wall along with the transmission shaft, thereby exposing the slot in the actuator arm of the latch mechanism. By inserting a screw driver or other crude tool through the lock opening and into the actuator arm slot, and twisting the tool, e.g. clockwise, the latch mechanism may be similarly unlatched, thus opening the trunk lid.

Third, by placing a screwdriver or similar tool into the keyway of the key lock and hitting it with a hammer, the lock mechanism can easily be driven inwardly through the opening in the exterior wall. A simple twist of the loose lock mechanism and transmission shaft will accomplish the unlatching of the latch mechanism directly, thus opening the trunk lid.

Various provisions have been made heretofore to prevent unauthorized entry into trunk compartments of motor vehicles. These usually involve strong protective structures seeking to withstand gross forces made by crude tools of the type discussed above, to frustrate such unauthorized entry. Their purpose is to reinforce the vulnerable area around the lock mechanism or the transmission shaft, so that the forced entry will be delayed or will require more persistent effort.

Of course, the longer it takes to accomplish the break in, the more chance there will be that the thief will get caught. However, in unattended or desolate areas or at night, there is much less likelihood that such a thief will get caught, even if a greater degree of time and effort is needed to complete the break in.

In this regard, U.S. Pat. No. 3,740,980 to Schimizzi et al discloses the use of a hollow sleeve of sturdy and durable material to surround the usual transmission stem or shaft which interconnects the motor vehicle trunk lid lock mechanism and latch mechanism. This arrangement affords protection mainly against the first break-in method discussed above, in which direct contact is made with the flat shaft by the punching tool, since if the lock mechanism can be pried out completely from or driven inwardly through the lock opening, the latch mechanism will become exposed or rendered vulnerable to the second and third break-in methods.

U.S. Pat. No. 3,868,836 to La Roche discloses an upright and transversely extending bracket-shield arrangement and a first retention clip at the rear end of the lock mechanism, for reinforcing the seating of the lock mechanism in the lock opening of the motor vehicle trunk lid to resist twisting of the lock mechanism relative to the trunk lid and longitudinal withdrawal of the lock mechanism from the bracket-shield and trunk lid. The bracket-shield also prevents in-line access to the latch mechanism by means of a tool used to punch a hole adjacent the lock mechanism through the trunk lid. A second retention clip is provided at the front end of the lock mechanism to seal the front end against the trunk lid at the lock opening. This relatively complicated and expensive arrangement affords some protection against all three break-in methods discussed above. However, the use of strong forces and special heavy tools may still lead to the opening of the trunk lid by the second and third break-in methods, in which the lock mechanism is pried out from or driven into the trunk lid at the lock opening, whereas a special, e.g. crank or offset tip type, tool for other than in-line access to the latch mechanism may still lead to the opening of the trunk lid by the first method, in which a punching tool makes direct contact with the flat shaft.

U.S. Pat. No. 3,345,839 to Brissette relates to an internal separate latch lock arrangement in a convertible motor vehicle, in which a vacuum operated flexible diaphragm or other electrical or mechanical drive type urging means is used to displace a bifurcated plunger, for blockingly engaging a flattened portion of the transmission shaft between the trunk lid lock mechanism and latch mechanism, to prevent the usual key operated twisting of the shaft and opening of the trunk lid at the same time as the convertible top storage lid is raised, i.e. in cases where these lids have interfering hinged paths. The operation of the bifurcated plunger is controlled remotely and automatically by raising the storage lid, as this releases a button plunger which starts the urging means for displacing the bifurcated plunger. However, this arrangement is only usable when the key lock is operated in normal manner to open the trunk lid while the convertible top storage panel is in raised position, and requires an additional or secondary lock of no real value in effectively preventing the second and third break-in methods.

U.S. Pat. No. 2,218,683 to Miller concerns a motor vehicle dashboard mounted lock mechanism connected via complex rotating and longitudinally reciprocating rod and crank linkages with an internal separate latch for locking the manual hood latch of the engine compartment, so that the lock mechanism, when unlocked, may be rotated or twisted to reciprocate the linkages to release the internal latch and permit normal manual release of the hood latch. When the manual hood latch is relatched in place at the engine compartment, the internal separate latch which is located adjacent thereto, due to a special cam connection, independently automatically relocks the hood latch, whether or not the dashboard lock mechanism is again relocked. This construction offers no protection against a direct break-in at the internal separate latch, since it is located adjacent the manual hood latch and may be released independently of the dashboard mounted lock mechanism.

U.S. Pat. No. 3,315,502 to Skrapits et al concerns the locking of a motor vehicle engine compartment hood by a key lock mechanism operated bolt, which is fixedly connected to the lock mechanism and moves longitudinally into a link opening in a chain depending from the hood. The key lock and bolt are normally urged by a spring outwardly of the chain path. This arrangement provides no protection against a direct break-in at the lock mechanism, such as by prying the lock mechanism completely out of the lock opening in the hood so as to withdraw the bolt from the chain link opening.

U.S. Pat. No. 3,529,452 to Rae concerns an obviously expensive and precisely constructed dashboard lock mechanism fixedly connected to a Bowden cable or a circular rod for longitudinal movement to release the bonnet catch of a motor vehicle bonnet or hood. The lock mechanism, upon unlocking, is rotatable in a non-rotatable but longitudinally movable intermediate sleeve to permit conjoint longitudinal movement therewith, all within a stationary outer sleeve and casing. The inner end of the lock mechanism contains a splined shaft connected to the Bowden cable or the circular rod. The splined shaft is longitudinally outwardly movable through an inner end wall of the stationary outer sleeve or casing only when, upon unlocking, the lock mechanism is rotated relative to the intermediate sleeve so as to register the shaft splines with segmental openings in the stationary inner wall, whereby to move the Bowden cable or the rod and in turn release the bonnet catch. The lock mechanism is lockable with the intermediate sleeve to prevent its rotation relative to the non-rotatable sleeve and thus to prevent the registering of the splines of the simultaneously rotatable splined shaft with the segmental openings in the stationary inner end wall, and in turn to prevent outward longitudinal movement of the intermediate sleeve carrying the lock mechanism, splined shaft and bonnet releasing Bowden cable or circular rod, relative to the inner end wall of the stationary outer sleeve or casing. A return spring is loaded between the splined shaft and the inward side of the stationary inner end wall, for urging the splined shaft and thus the lock mechanism longitudinally inwardly to the locking position. This relatively complicated and expensive arrangement will not prevent the prying of the lock mechanism, intermediate sleeve and outer sleeve and casing completely out of the lock opening in the dashboard or other accessible wall in which these parts may be situated for releasing the bonnet catch, nor will it prevent the use of a punching tool in the case of a Bowden cable containing arrangement for by-passing the outer sleeve and casing and exerting a pulling force on the Bowden cable for the same purpose.

In all of these constructions for locking closable spaces such as motor vehicle compartments, the parts are arranged such that persistent effort generally will result in a break-in, usually accompanied by a partial or complete destruction of the lock mechanism or the latch mechanism, or both. Thus, the overall cost of the theft will be the value of the items stolen plus the expense of repairing or replacing the damaged lock and/or latch parts. The partial or complete destruction of the lock and/or latch parts would be a small price to pay, if after such destruction the hood or lid or door of the closed space or compartment could still not be opened to permit the theft of the items contained therein.

It is among the objects and advantages of the present invention to overcome the drawbacks and deficiencies of prior art lock and latch constructions and other motion transmission assemblies, and to provide a tamper deactivating motion transmission assembly, such as for operatively interconnecting a lock and a latch, in which a force transmitting shaft is used to interconnect a force applying part with a force actuating part under the reserve tension of an urging force which when disturbed will cause the force actuating part to be urged to a deactivating or demounted position, and from which return to the activating or remounted position is either per se prevented or rendered so extremely difficult that it cannot be achieved as a practical matter by the person tampering with the assembly.

It is among the additional objects and advantages of the present invention to provide an assembly of the foregoing type, in which the force actuating part is mounted on a bearing for pivotal movement at an activating position and for deviating movement relative to the bearing to a deactivating or demounted position under an interposed urging force, and is only maintained in the activating position by operatively disposing the force transmitting shaft when attached under tension to the force applying part against the interposed urging force.

It is among the further objects and advantages of the present invention to provide such an assembly in a latch and lock arrangement; in which the tail end of a pivotal force transmission shaft is operatively attached to a pivotal force applying lock mechanism to achieve operative disposition of the shaft, and the head end of the shaft is operatively connected to the force actuating part operatively mounted on the bearing at the activating position; in which the force actuating part is arranged when at the activating position to be pivoted by the shaft upon operating the lock mechanism, for driving a release linkage of the latch mechanism to unlatch the latch mechanism; and in which urging means are operatively interposed between the latch mechanism and the force actuating part for placing the shaft under reserve tension; whereby upon disturbing the tension attachment disposition of the tail end of the shaft at or relative to the lock mechanism, the urging means will urge the force actuating part to deactivating position, as aforesaid.

It is among the further objects and advantages of the present invention to provide such an assembly in which the shaft is of substantially curved, e.g. continuously curved or rounded, cross section, to prevent the applying of tangential torque thereto for turning or twisting the shaft, and preferably in which the shaft is flexible, e.g. freely or readily locally flexibly displaceable from its normal longitudinal axis, for accommodating any misalignment of the parts to which it is connected, while being substantially incapable of torsional twisting or rotational displacement of one end thereof relative to the other along its length in any position of local flexible displacement from its normal longitudinal axis, as well as substantially incapable of longitudinal stretching or axial elongation, i.e. under the contemplated tension forces exerted by the urging means.

It is among the further objects and advantages of the present invention to provide an assembly of the foregoing type, in which the force actuator part is selectively sized and shaped in relation to interfering means, such as the release arm of a release linkage of a latch mechanism, such that when in activating position the force actuator part engagingly displaces the release arm or other interfering means against a biasing force normally urging the release arm or other interfering means into at least a portion of the space to be occupied by the force actuator part at the activating position, whereby upon movement of the force actuator part to the deactivating or demounted position, the release arm or other interfering means is urged into such space to prevent the return movement of the force actuator part to activating position or remounted position.

It is among the further objects and advantages of the present invention to provide an assembly of the foregoing type for inclusion in a latch and lock arrangement in a motor vehicle, such as for locking the trunk lid or deck lid compartment thereof, and especially as a replacement or add-on kit assembly therein, to prevent break-in, and particularly resulting in at most the repair or replacement of damaged or destroyed parts caused by an attempted break-in, while avoiding the theft of items contained in the compartment, all without the need for special structural or armor type extra reinforcement protecting means.

It is among the further objects and advantages of the present invention to provide an assembly of the foregoing type in a latch and lock arrangement in a motor vehicle, such as for locking the trunk lid or deck lid compartment thereof, which will result in the deactivating of the latch mechanism, where access is gained through the lock opening such as by prying the lock mechanism completely out of or driving the same completely inwardly through the lock opening, or where a tool is driven through the adjacent wall in an attempt to apply a tangential torque directly to the transmission shaft interconnecting the lock mechansim and the latch mechanism.

It is among the further objects and advantages of the present invention to provide such an assembly, which is simple and inexpensive in construction, obtainable from readily available parts and materials, easily assembled and incorporated in latch and lock arrangements as new or replacement parts, adaptable to convenient constructional modification, efficiently usable in replacement or add-on kit form for substitution of corresponding parts in existing latch and lock arrangements with a minimum of modification and time, and durable and generally unfailing in operation in any weather or climate and at any encountered temperature, and despite changes in temperature and even at temperatures below freezing, for preventing break-in by tamper deactivating the latch and lock arrangement, while otherwise permitting normal use of the arrangement, e.g. by key operation of the lock.

Figure 2:
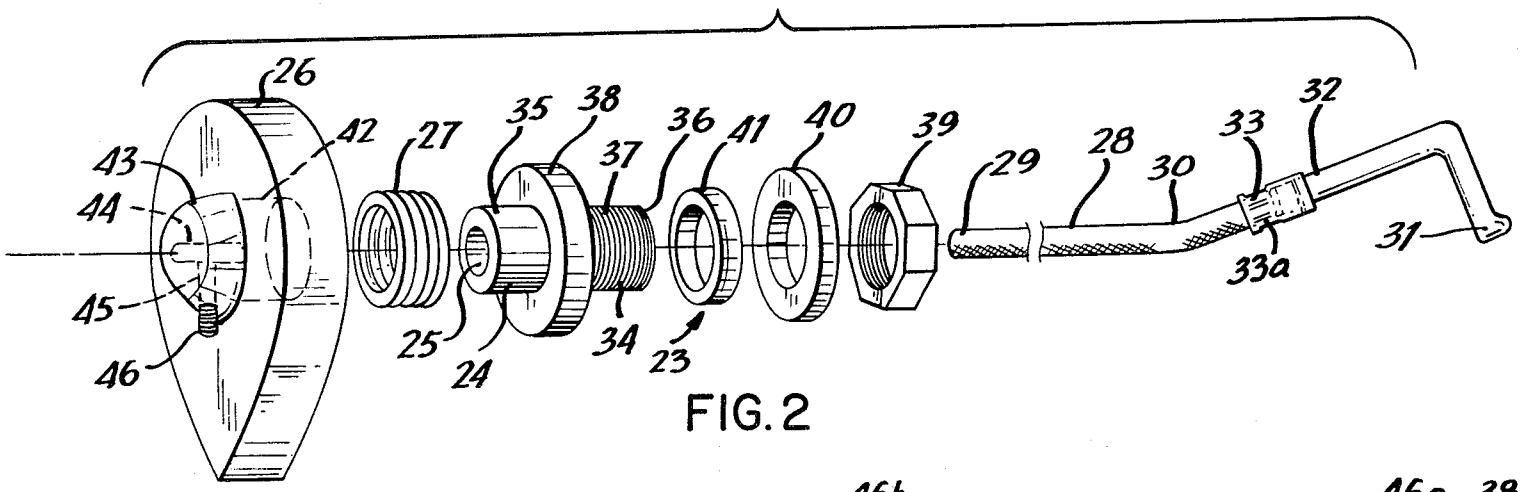
Figure 5:
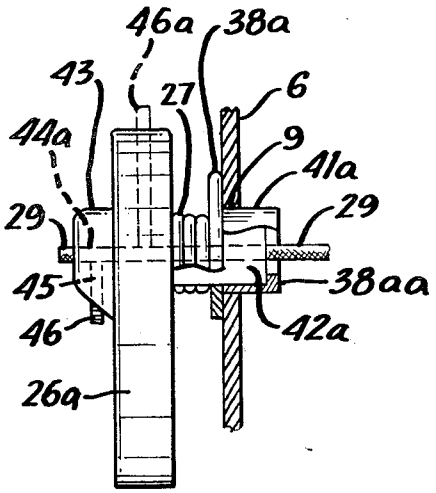
Figure 6:
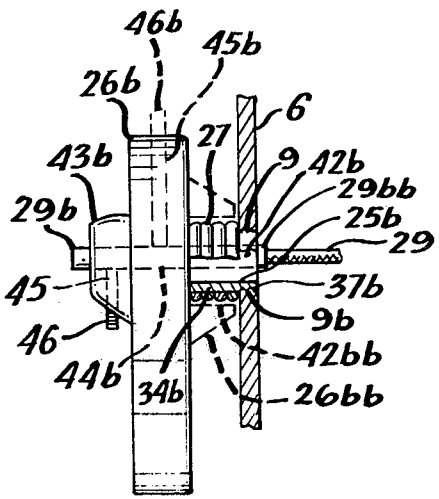
Figure 4:
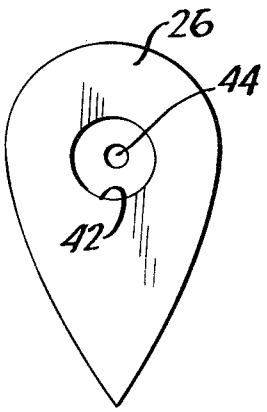
Figure 3:
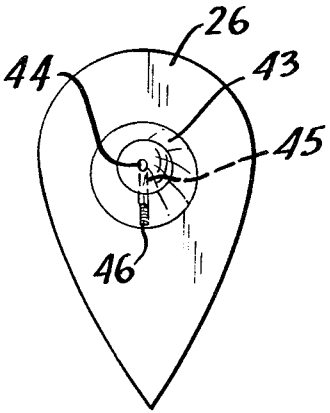
Figure 7:
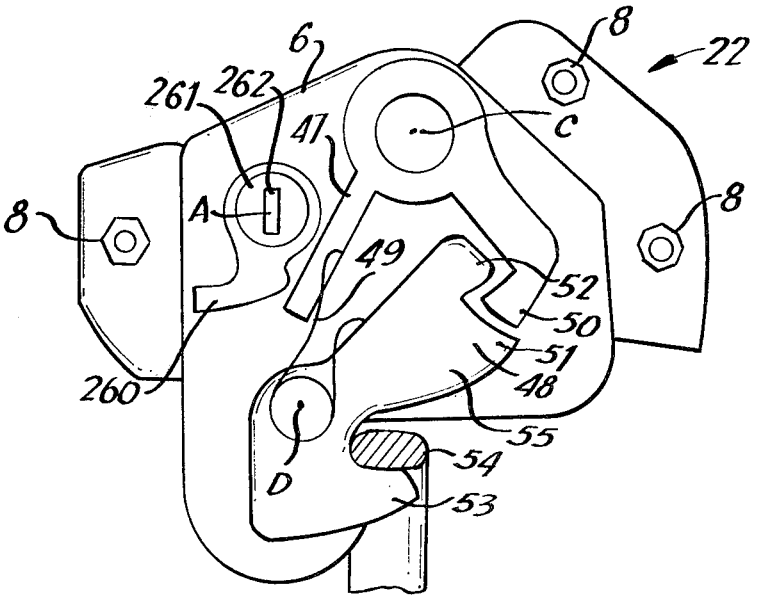
PRIOR ART FIG. 7
Figure 8:
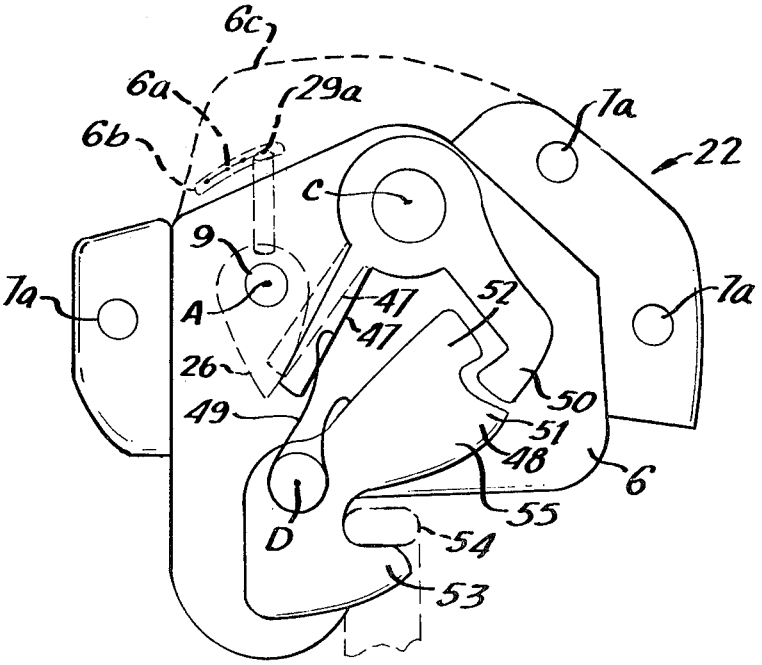

Other and further objects and advantages of the present invention will become apparent from a study of the within specification and accompanying drawings, in which:

FIG. 1 is a schematic view partially in section of a motor vehicle compartment deck lid or trunk lid containing an exterior lock mechanism and interior latch mechanism and which includes an interconnecting or pivotal force transmission assembly according to the present invention, FIG. 2 is a schematic view showing the more pertinent individual parts of the assembly of FIG. 1 in exploded relation, apart from the lock mechanism and latch mechanism proper, FIGS. 3 and 4 are schematic top and bottom views, respectively, of the axial journal recess or cup containing actuator embodiment shown in FIG. 1, FIGS. 5 and 6 are schematic views of modified axial journal projection or spindle containing actuator embodiments according to the present invention, showing respective modified shaft connection arrangements therefor and modified bearings therefor mounted in the receiving aperture or wide bore of the latch mechanism shown in FIG. 1, FIG. 7 is a schematic elevation of a PRIOR ART latch mechanism of the type shown in FIG. 1, as seen from inside the trunk compartment of the motor vehicle, when the trunk lid or deck lid is in closed and latched condition, and showing a conventional slot containing latch release actuator arm pivotably mounted in a receiving aperture or wide bore in a wall portion of the latch mechanism, for actuating the release arm of the release linkage to release in turn the locking arm thereof from the striker on the body of the motor vehicle, for unlatching the latch mechanism against the biasing force of a return spring operatively interposed between the release arm and locking arm, and FIG. 8 is a schematic view of a modified form of the latch mechanism shown in FIG. 7, in which the original slot containing latch release actuator arm has been removed, and showing in phantom at the receiving aperture or wide bore the disposition thereat of the actuator shown in FIGS. 1 to 4, or in FIG. 5 or in FIG. 6, and also in phantom the overlapping interfering position of the release arm when in the normal biased position shown in FIG. 7, and additionally showing in full line the offset actual position of the release arm when the actuator according to the invention is pivotally mounted in activating position at the receiving aperture.

In accordance with the present invention, a tamper deactivating pivotal motion transmission assembly is advantageously provided for preventing break-in upon disturbance of the tension disposition of the system, for instance when employed as a motion transmission interconnection between a force applying part and a force actuating part, such as in a latch and lock arrangement in a motor vehicle compartment locking system.

The assembly comprises a bearing member, e.g. having an inward or facing side and an outward or opposite side; an actuator operatively mounted on the bearing member, e.g. at the inward side thereof, for pivotal movement at an actuating position thereon and for deviating, e.g. unilateral, movement from the activating position to a deactivating, e.g. demounted, position out of operatively mounted relation therewith; urging means, e.g. unilateral or resilient urging means such as a spring, arranged for urging the actuator to the deactivating position; and a pivotal force transmitting shaft having a head end operatively connected to the actuator for conjoint movement of the actuator and shaft relative to the bearing member, and a tail end, e.g. at the outward side of the bearing member, and selectively remote from the actuator and bearing member and arranged for attachment under tension at a corresponding remote reference point for maintaining the actuator at the activating position against the force of the urging means and for receiving a pivotal force applied to the tail end at the reference point for pivoting the shaft and actuator.

In this way, upon disturbing the tension attachment disposition of the tail end at or relative to the reference point, the urging means will urge the actuator to the deactivating position, e.g. demounted from the bearing member.

Preferably, the shaft has a substantially curved, e.g. continuously curved or rounded, and especially circular, cross section or external surface profile.

More specifically, the bearing member may have a slide portion containing an open ended bore substantially concentric to a pivot axis and extending through the bearing member from one side to the other side of the bearing member, and the actuator may be operatively mounted on the slide portion substantially concentric to the bore for pivotal movement about the axis at the activating position and for deviating movement to the deactivating position out of operatively mounted relation with the slide portion.

In turn, favorably the shaft head end may be substantially axially operatively connected, especially releasably adjustably, to the actuator, e.g. for pivotal movement of the actuator and shaft relative to the bearing member, i.e. upon applying a pivotal force to the shaft, and for substantially axial movement of the shaft relative to the bearing member in the direction from the outward side to the inward side of the bearing member, i.e. upon applying the urging force of the urging means to the actuator.

In particular, besides having a substantially curved cross section, the shaft is preferably a flexible shaft which is locally flexibly displaceable from its normal longitudinal axis, and when arranged under tension is substantially incapable of tortional twisting or rotational displacement of one end thereof relative to the other along its length, in any position of local flexible displacement from its normal longitudinal axis. Also, desirably the shaft is substantially incapable of longitudinal stretching or axial elongation under the contemplated tension forces exerted by the urging means.

Moreover, the shaft tail end preferably has an attachment portion, e.g. which is adapted for selectively, especially releasably, attaching the shaft under tension at the remote reference point to a pivotal force applying source, such as a lock mechanism, adapted to the disposed thereat.

According to a desirable tubular slide portion bearing member embodiment of the present invention, the slide portion includes a hollow tube having a hollow free end and a hollow seating end and containing the aforesaid bore as an open ended bore therethrough. The actuator is operatively freely slidably mounted on the tube free end, and the urging means preferably include resilient urging means, such as a spring, operatively arranged for urging the actuator off of the tube free end to the deactivating position, i.e. arranged for urging the actuator to demounted or separated position with respect to the bearing member.

The shaft head end favorably is substantially axially, especially releasably adjustably, connected to the actuator and may conveniently extend partially or completely through the bore for achieving such axial connection.

In this tubular embodiment, preferably, the shaft has a substantially curved cross section and is flexible yet incapable of such tortional twisting as aforesaid, the shaft head end extends through the hollow tube bore, the actuator contains an axial journal recess or cup, the shaft head end and tube free end substantially concentrically project into the recess, the urging means include a coil spring disposed in the recess substantially concentrically outwardly of the tube free end and operatively loaded between the actuator and the adjacent portion of the bearing member when the actuator is in the activating position, the recess has shaft connecting means for selectively, and especially releasably adjustably, connecting the shaft head end to the actuator thereat, and the shaft tail end has an attachment portion which, as aforesaid, is adapted for selectively attaching the shaft under tension at the remote reference point to a pivotal force applying source, such as a lock mechanism, adapted to be disposed thereat.

Alternatively, instead of an axial journal recess, the actuator may have an axial journal projection or spindle selectively sized and shaped for sliding coaction with the slide portion bore and for operative connection with the shaft head end therethrough, so that the projection is slidably mounted in the bore for such pivotal and deviating movement, whether the bore is in the form of an open ended bore per se defined in a wall portion of the bearing member and the projection is slidably mounted therein, or is in the form of an open ended internal bore in a hollow tube of the bearing member, and the projection is slidably mounted therein on the tube free end.

In the case of the hollow tube form, the same may be readily provided as a tubular extension flange at the margins of an open ended receiving aperture defined in a wall portion constituting the bearing member, or as a separate and independent, e.g. add-on, hollow tube fixedly seated at or in the receiving aperture, as the artisan will appreciate.

In accordance with a specific latch and lock arrangement, the present invention contemplates a tamper deactivating pivotal motion transmission assembly comprising a latch mechanism or body latch and a lock mechanism or key lock, incorporting the instant bearing member, actuator, urging means and shaft.

The latch mechanism includes a bearing member having an inward side and an outward side and a slide portion containing an open ended bore substantially concentric to a pivot axis and extending through the bearing member from one side to the other side of the bearing member, and also includes a release linkage adjacent to the axis to unlatch the latch mechanism.

As aforesaid, the slide portion bore may be provided in the form of an open ended bore per se defined in a wall portion of the latch mechanism constituting the bearing member, or may be provided in the form of an open ended internal bore in a hollow tube of the bearing member, e.g. provided as a tubular extension flange at the margins of an open ended receiving aperture defined in a wall portion of the latch member constituting the bearing member, or as a separate and independent hollow tube fixedly seated at or in an open ended receiving aperture or wide bore defined in such wall portion of the latch mechanism.

The lock mechanism is suitably disposed at a selectively remote reference point spaced from the latch mechanism and includes a pivotal force applying portion or rotatable lock cylinder.

In this arrangement, the actuator is operatively mounted on the slide portion substantially concentric to the bore at the inward side of the bearing member for pivotal movement about the axis at an activating position thereon, and is selectively sized and shaped for coacting relation at the activating position with the release linkage for actuating the release linkage to unlatch the latch mechanism. The actuator is also operatively arranged on the bearing member for deviating movement from the activating position to a deactivating, e.g. demounted, position out of operatively mounted relation with the slide portion and out of coacting relation with the release linkage.

In turn, the urging means are preferably resilient urging means operatively arranged between the actuator and the latch mechanism for urging the actuator to the deactivating or demounted position.

Additionally, preferably a pivotal force transmitting linear tension shaft is provided in this arrangement which has a substantially curved cross section, which has a head end, e.g. extending through the bore, substantially axially operatively, especially releasably adjustably, connected to the actuator for pivotal movement of the actuator and shaft relative to the bearing member, i.e. upon applying a pivotal force to the shaft, and for substantially axial movement of the shaft relative to the bearing member in a direction from the outward side to the inward side of the bearing member, i.e. upon applying the urging force of the urging means to the actuator, and which has a tail end at the outward side of the bearing member and correspondingly remote from the actuator and bearing member.

The tail end is attached, especially selectively releasably, under tension to the pivotal force applying portion of the lock mechanism at the stated reference point for thereby maintaining the actuator at the activating position against the force of the urging means and for thereby receiving a pivotal force applied to the tail end for pivoting the shaft and actuator to unlatch the latch mechanism, whereby upon disturbing the tension attachment disposition of the tail end at or relative to the lock mechanism, the urging means will urge the actuator to deactivating or demounted position.

As earlier noted, the shaft in this arrangement is preferably flexible yet incapable of tortional twisting in the contemplated manner. Likewise, the shaft tail end preferably has an attachment portion arranged for selectively, e.g. releasably, attaching the shaft under tension to the pivotal force applying portion of the lock mechanism.

Significantly, interfering means may be advantageously provided which are operable upon movement of the actuator from the activating position to the deactivating or demounted position to prevent the return of the actuator to the activating position. Such interfering means may be favorably provided in the release linkage itself.

In this regard, the release linkage may desirably include a reciprocally displaceably mounted release arm normally resiliently biased to an interfering or rest position situated in at least a portion of the space occupied by the actuator when at the activating position. Correspondingly, the actuator may be selectively sized and shaped relative to the release arm when at the interfering or rest position for engagingly displacing the release arm from the interfering or rest position when the actuator is operatively mounted on the bearing member and disposed at the activating position.

Hence, upon disturbing the tension attachment disposition of the tail end at or relative to the lock mechanism, the urging means will urge the actuator away from the bearing member to the deactivating or demounted position, and thereby prevent the unlatching of the latch. In turn, the release arm as interfering means will be displaced to the interfering or rest position to prevent the remounting of the actuator operatively on the bearing member and thus the return of the actuator to the activating position.

More particularly, the latch and lock arrangement may be located advantageously in a motor vehicle for locking a compartment lid such as a trunk lid or deck lid thereon, the motor vehicle correspondingly including an exterior wall containing a lock opening and an interior wall spaced inwardly from the exterior wall. Conveniently, the lock mechanism or key lock is disposed in the lock opening at the exterior wall, and the latch mechanism or body latch is disposed at the interior wall and includes a wall portion provided with the bearing member, slide portion and bore.

Here also, the slide portion bore may constitute an open ended bore per se in the wall portion of the latch mechanism or an open ended internal bore in a hollow tube fixedly seated around an aperture in such wall portion. In all such instances, the corresponding margins of the bore in the wall portion of the latch mechanism inherently define the slide portion as a slide bearing thereat and/or therein, whether as a wall bore bearing or as a hollow tube bore bearing.

As before, the shaft is preferably of curved cross section and flexible yet incapable of tortional twisting in the contemplated manner, and the shaft tail end preferably has an attachment portion arranged for selectively, e.g. releasably, attaching the shaft under tension to the pivotal force applying portion of the lock mechanism.

Moreover, the actuator preferably has shaft connecting means for selectively axially, e.g. releasably adjustably, connecting the shaft head end thereto, i.e. through the bore, preferably with the shaft head end extending through the bore for this purpose to the extent necessary to reach such shaft connecting means. Also, the urging means are advantageously arranged for urging the actuator, e.g. axially, away from the bearing member to demount the actuator therefrom, whereby to permit the interfering means, e.g. release arm, to move to interfering position.

Accordingly, upon disturbing the tension attachment disposition of the tail end at or relative to the lock mechanism, such as in gaining access through the lock opening by prying the lock mechanism out from the vehicle exterior wall or by driving the lock mechanism inwardly through the vehicle exterior wall, the urging means will urge the actuator to demount the actuator from the bearing member and prevent the unlatching of the latch mechanism, and in turn the interfering means or release arm will be displaced to the interfering position to prevent the remounting of the actuator on the bearing member, whereas upon driving a tool through the vehicle exterior wall in an attempt to apply a tangential torque directly to the shaft to pivot the actuator for unlatching the latch mechanism, the flexible nature, and more importantly the curved cross section, of the shaft will prevent such attempt from succeeding.

Referring to the drawing, and initially to FIG. 1, a conventional deck lid or trunk hood 1 of a motor vehicle such as an automobile is shown, e.g. of the type having rear hinges (not shown) for mounting the lid in the form of a door which is sized and shaped to close the opening of a storage compartment or trunk (not shown) provided in the vehicle.

The deck lid 1 has an exterior lid wall or outer shell 2, generally conventionally constructed of relatively thin gauge metal, and an interior lid wall or inner support panel 3 spaced inwardly from the exterior lid wall 2, yet conveniently interconnected therewith as at upper wall connection 4 and lower wall connection 5 by suitable means, e.g. welding, crimping, or the like, to form a common deck lid structure of selective external configuration or contour.

Depending on the configuration or contour of the deck lid 1, a selectively sized and shaped interior lid wall web portion or cut out support plate **3*a* extends as a more or less upright or transverse member between the outer portion of the interior lid wall 3 and the adjacent inner portion of the exterior lid wall 2, serving as a reinforcing and mounting bracket. Support plate 3*a* has a large access cut out slot 3*b* therethrough, and may be a separate member interconnected to the interior lid wall 3 by suitable means, as aforesaid, or may be an inward and upward integral cut out slot containing extension of the remainder of interior lid wall 3**, forming a composite one piece interior lid wall therewith.

A suitably flanged upright or transverse latch back plate or wall plate portion 6 is mounted on interior lid wall 3 at cut out support plate **3*a* by suitable means, preferably releasable connecting means such as mounting bolts 7 and mounting nuts 8. Latch wall portion 6 is provided with an open ended receiving aperture or comparatively wide bore 9**, which is substantially concentric to a longitudinal main pivot axis A extending therethrough.

Latch wall portion 6 is preferably arranged relative to the receiving aperture 9 such that it lies in a plane substantially normal to main axis A, and particularly preferably such that latch wall portion 6 normally lies in a substantially vertical reference plane and the main axis A lies in a substantially horizontal reference plane.

Latch wall portion 6 is suitably mounted on cut out support plate **3*a* in registry with the large cut out slot 3*b* therein to provide free access to the interior area between the support plate 3 and the adjacent inward side of the latch wall portion 6 (see FIG. 1**).

Exterior lid wall 2 is provided with a lock opening 10 in which a conventional lock mechanism or key lock 11 is fixedly mounted, via the outer flange portion or key lock face 12. Key lock 11 is held in place in lock opening 10 by appropriate retaining means, such as by a key lock retainer 13, which may be provided in the form of a U-shaped aperture containing bracket or clip, interposed in a continuous or discontinuous peripheral retaining groove on the lock mechanism 11 and under friction engagement therewith.

Such retaining groove is generally defined between the rear side of the outer flange portion or key lock face 12 and the front side of a continuous or discontinuous shoulder, here provided as a pair of diametrically opposed shoulder lugs 14, only one of which is shown.

Key lock retainer 13 may be fixedly attached to the deck lid 1 in any manner, such as by attachment to the underside of the interior lid wall 3 by one or more retainer screws 15 in the usual way. For this purpose, the upper end of retainer 13 may be upwardly inserted through an opening or slot provided in the interior lid wall 3, and may have a mounting flange portion at the lower end thereof adjacent the margins of the slot in the interior lid wall 3 through which the retainer screw or screws 15 may pass, to achieve a desired releasable type of attachment.

Hence, to remove the lock mechanism 11, the retainer screw or screws 15 are removed and the retainer 13 pulled down to release the same from engagement with the grooves between lock face 12 and shoulder lugs 14, and to install or replace the lock mechanism 11 the procedure is reversed.

The lock mechanism 11 includes an outer stationary key lock case 16, on which the key lock face 12 and shoulder 14 are provided, and an inner rotatable key lock cylinder 17, operatively rotatably mounted in the key lock case 16 in suitable manner, and whose rotation or pivoting is controlled by the key 18 in the usual way, upon unlocking the lock mechanism 11 by twisting the key, e.g. clockwise, in the lock mechanism.

The key lock cylinder 17 may contain a rear attachment seat or eye 19 in an exposed portion thereof adjacent an extension 20 at the rear portion of the key lock case 16, and a coil spring 21 may be mounted over the stationary case extension 20 and the exposed portion of the rotatable cylinder 17 which contains the eye 19.

One end portion of the coil spring 21 is operatively connected to the case extension 20 and the other end portion thereof is operatively connected to the exposed portion of the rotatable cylinder 17, so as to fit around the eye 19. Thus, the spring 21 serves as a return spring to return the cylinder 17 and key 18 to their normal position, after the key has been turned to open the lock.

It will be noted that in the deck lid construction shown, the configuration and contour of the exterior lid wall 2 is such that the lock opening 10 lies in a plane at an angle to the vertical and in turn the lock cylinder 17 rotates about an inclined pivot axis B, which intersects the horizontal reference plane in which the main pivot axis A extends.

However, where the configuration and contour of the exterior lid wall 2 is such that the lock opening 10 lies in a vertical reference plane, the lock opening may be selectively located to render the same substantially concentric to main axis A.

In this instance, the axis of rotation B of the lock cylinder 17 will advantageously coincide with the main pivot axis A, as the artisan will appreciate. In turn, the receiving aperture or wide bore 9 in latch wall portion 6, and the lock cylinder 17 in the lock mechanism 11 at a remote reference point selectively spaced from the latch wall portion 6, will both be concentric to the common composite resultant pivot axis A-B.

In accordance with the present invention, a lock and latch arrangement linkage is provided in the linear or longitudinal space between the lock mechanism or key lock 11 and a latch mechanism or body latch 22, disposed at the interior lid wall web portion or support plate 3*a*, and which includes various latch parts conveniently mounted on the latch wall portion 6 (cf. FIGS. 7 and 8). Access to such latch parts from the inward side of the compartment lid is conveniently provided via the usual large cut out slot 3*b* in the support plate 3*a* thereat.

As shown in FIGS. 1 and 2, the lock and latch arrangement linkage constitutes a tamper deactivating pivotal motion transmission assembly 23. The assembly 23 includes a bearing member 24, containing an open-ended central bore 25 operatively arranged substantially concentric to the main axis A, an actuator 26 operatively mounted on the bearing member 24 for pivotal movement of the actuator about the axis A at an axial activating position (see FIG. 1), and for deviating axial movement of the actuator out of operatively mounted relation with the bearing member to a deactivating or demounted position (shown in phantom in FIG. 1), urging means 27, e.g. resilient urging means such as a coil spring, arranged for urging the actuator 26 to the deactivating position, i.e. in a direction away from both the bearing member 24 and the lock mechanism 11 so as to demount the actuator from the bearing member, and a pivotal force transmitting linear tension shaft 28.

Access at the latch mechanism 22 to all these parts is possible, as aforesaid, through the large cut out slot 3*b* usually provided in the support plate 3*a*. Hence, sufficient free space exists thereat for the actuator 26 to demount from the bearing member 24 without hindrance from the support plate 3*a* (cf. FIG. 1).

Shaft 28 has a head end 29, e.g. extending through the bore 25, which is substantially axially operatively connected to the actuator 26 for conjoint movement of the actuator and shaft relative to the bearing member 24 and the bore, i.e. for conjoint movement both rotationally about axis A and axially along axis A such as in an axial direction away from the remote reference point at which lock mechanism 11 is disposed.

Conversely, shaft 28 has a tail end 30 selectively remote from the actuator 26 and bearing member 24, and which is arranged for attachment under tension at the corresponding remote reference point at which lock mechanism 11 is disposed, for maintaining the actuator at the activating position (see FIG. 1) against the force of the urging means 27 and for receiving a pivotal force applied to the tail end 30 at such reference point for pivoting the shaft and actuator.

For this purpose, a catch member or hook 31, conveniently having a rearwardly extending, preferably round cross sectional, shank 32, may be provided along with a ferrule or tubular collar 33. These parts constitute a simple and efficient composite attachment portion for the shaft tail end 30.

The collar 33 may be readily crimped by a simple crimping tool, or swaged, over the opposing or facing portions of the tail end 30 and the shank 32 inserted thereinto, to couple the shaft 28 to the hook 31.

Accordingly, the hook 31 may be readily releasably inserted in conventional manner into the eye 19 of the lock cylinder 17, which thereby constitutes a pivotal force applying portion for applying a pivotal force through the shaft 28 to the actuator 26. The key lock coil spring 21 in this regard conveniently also serves to hold the hook 31 in place in the eye 19 of the lock cylinder 17, the hook 31 inherently forming an articulated attachment with the eye 19 and in turn an articulated attachment between the tail end 30 and the pivotal force applying portion of the lock mechanism 11 (see FIG. 1).

Of course, any other suitable attachment means may be provided for selectively releasably operatively attaching the shaft 28 to the lock cylinder 17, for maintaining the actuator 26 at the activating position against the force of the urging means 27 and for receiving the pivotal force applied to the tail end 30 at the corresponding remote reference point in question for pivoting the shaft 28 and in turn the actuator 26 in the desired manner, as the artisan will appreciate.

More specifically, the bearing member 24 may be provided in the form of a hollow tube 34 having a hollow free end 35 as the bearing portion or slide portion and a hollow seating end 36, and containing the bore 25 as an open ended internal bore therethrough. The tube free end 35 constitutes the inward or facing side of the bearing member 24 and the tube seating end 36 constitutes the outward or opposite side thereof.

Thus, the actuator 26 is operatively freely slidably mounted on the inward or facing side of the bearing member 24 via the tube free end 35. Tube free end 35 is conveniently provided with a smooth bearing contact surface, so that the actuator 26 may slide freely operatively thereon or relative thereto both in rotational and axial direction, and especially so that the urging means 27 will be able to urge the actuator 26 effectively off of the tube free end to deactivating or demounted position.

On the other hand, the tube seating end 36 of the bearing member 24 is conveniently provided with a seating surface readily mountable in the latch mechanism 22. For this purpose, tube seating end 36 may be provided with an external thread portion 37 and an intermediate flat shoulder or open ended bore-containing wall portion or flange 38, such that the tube free end 35 projects outwardly from the wall portion or flange 38 along the axis A in a direction away from the tube seating end 36 and outward side of the bearing member 24 and terminates in an end edge.

Thus, the tube seating end 36 may be inserted through the receiving aperture or wide bore 9 in the latch wall portion 6 in a direction towards the lock mechanism 11 until shoulder 38 abuts against the latch wall portion, and then be fixedly mounted thereon via an appropriate locking nut 39 tightened over the threaded portion 37, in the usual manner.

A flat washer 40 may be optionally interposed between the nut 39 and the adjacent side of the latch wall portion 6 for the normal purpose.

Accordingly, the instant assembly may be advantageously provided as a replacement or add-on unit of an existing latch mechanism 22. Where the existing receiving aperture 9 thereof is too large in inside diameter to accommodate acceptably the corresponding outside diameter of the hollow tube 34, and specifically that of the tube seating end 36, and optional selectively sized spacer bushing 41 may be inserted in the receiving aperture 9 to take up the extra annular space between these parts and eliminate any undesired or excessive play thereat.

On the other hand, the hollow tube 34, and specifically the tube seating end 36 may be initially selectively sized in outside diameter to match the inside diameter of the receiving aperture 9 to obviate the need for any such bushing 41. Additionally, if the receiving aperture 9 is too small in inside diameter to accept the tube seating end 36 therein, the receiving aperture 9 may be simply reamed to increase its inside diameter, as necessary.

Generally, however, it is more preferred to provide the hollow tube 34, and specifically the tube seating end 36, of a desirably smaller outside diameter than the inside diameter 9 of the usual latch mechanism 11, and compensate for any difference by utilizing an appropriately sized bushing 41, as and if necessary.

Naturally, the size of the bushing 41 is not critical, and its inclusion is merely to minimize or eliminate undesired or excessive play, since the locking nut 39 and flat shoulder 38 will normally be sufficient to keep the hollow tube 34 and latch wall portion 6 in tight fixed connection with each other, despite any annular gap between the aperture 9 and the tube seating end 36, i.e. under the service conditions contemplated for these parts according to the present invention.

As may be appreciated from FIGS. 3 and 4, actuator 26 is provided at the side thereof adjacent to the bearing member 24 with an axial journal recess or cup 42, selectively sized to slidably receive the tube free end 35 concentrically therein, and a crown 43 remote from the bearing member 24 which serves to close off the recess 42.

The crown 43 contains an axial bore 44 sized to receive and house the shaft head end 29, and a threaded cross bore or radial bore 45 communicating therewith and into which a set screw 46 extends from the exterior of the crown 43.

The axial bore 44, cross bore 45 and set screw 46 thus constitute a convenient composite shaft connecting means for releasably axially adjustably selectively connecting the shaft head end 29 to the actuator 26.

Of course, any other suitable connection means may be provided for operatively connecting the shaft head end 29 to the actuator 26, as the artisan will appreciate.

In this arrangement, the urging means 27 may be suitably provided in the form of a simple resilient compression urging means, such as a compression coil spring 27, selectively sized to fit within the recess 42 and be operatively loaded between the adjacent interior wall of the crown 43, defining the inner end or floor of the recess, and the flat shoulder 38, when the actuator 26 is mounted in activating position on the tube free end 35.

More specifically, the shaft head end 29 extends through the hollow tube bore 25, and the shaft head end and the tube free end 35 are selectively sized and arranged to substantially concentrically project into the recess 42, with the coil spring 27 selectively sized to be disposed in the recess substantially concentrically outwardly of the tube free end 35 and operatively loaded between the actuator 26, i.e. at the inner wall of the crown 43, and the adjacent portion of the bearing member 24, i.e. at the adjacent portion of the wall portion or flat shoulder 38.

The shaft head end 29 is favorably inserted through the axial bore 44 in the crown 43 and adjustably fixed in place therein by tightening the set screw 46 in the cross bore 45. Depending upon the tension on the shaft 28, the reserve force of the coil spring 27, and the relative axial sizing of the tube free end 35 and recess 42, and specifically of the position of the inside wall of the crown 43 constituting the floor of the recess relative to the end edge of the tube free end 35, the arrangement may take the form of a thrust bearing.

Of course, as the artisan will appreciate, the hollow tube 34 may be simply welded at the side wall surface margins of the receiving aperture 9, e.g. with or without an abutment flange for seating the tube against such side wall surface portions, or may be welded in inserted position within the aperture 9 itself, e.g. with or without a bushing 41, or the aperture 9 may be tapped to provide threads therein for screwing the tube seating end 36 thereinto, as the case may be.

Besides, the tube may be provided as an integral tubular raised portion or extension flange of the latch wall portion 6.

In such instances, the shoulder 38 and/or thread portion 37 may be omitted along with the locking nut 39, washer 40 and/or bushing 41, depending on the circumstances.

The net result will be a hollow tube 34 mounted on the latch wall portion 6 and constituting a bearing member 24 having a slide portion containing an open ended bore for suitably operatively mounting the actuator 26.

Moreover, by providing the actuator 26 with an axial journal projection or spindle, instead of the recess 42, and selectively sized and shaped for inserted sliding coaction with the aperture 9, optionally with a suitable bushing 41 in the aperture, as and if needed, the hollow tube 34 may be completely omitted, with the adjacent portion of the latch wall portion 6 thereby constituting the bearing member 24, with the margins of the aperture 9 constituting the slide portion, and with the aperture 9 itself constituting the open ended bore extending through the bearing member from one side to the other side thereof.

Similarly, by providing the actuator 26 with such an axial projection or spindle, instead of the recess 42, and selectively sized and shaped for inserted sliding coaction with the internal bore 25 in the hollow tube 34, the actuator may be mounted in the bore at the tube free end 35, rather than over the exterior surface thereat.

In this regard, as shown in the alternative embodiment of FIG. 5, in which corresponding parts to those in FIGS. 1 and 2 are assigned the same reference numerals, the actuator **26*a* is provided with an axial journal projection or spindle 42*a*, in place of the axial recess 42, for freely slidable insertion in the aperture 9 of the latch wall portion 6, optionally with a bushing 41*a*** to adjust the diameters of these parts, as and if necessary.

Bushing **41*a* may be optionally provided with a radially outward abutment flange or shoulder 38*a*, similar to shoulder 38, to facilitate the positioning of the bushing in the aperture 9, or may be welded in place in the aperture 9, or coacting threads may be provided in the bushing 41*a* and in the aperture 9** to achieve the desired connection.

Also, bushing **41*a* may be optionally provided with a radially inward abutment flange or shoulder 38*aa* at its opposite end remote from the actuator 26a to facilitate the thrust bearing seating and axial location of the axial projection 42a** therein.

In any case, the external surface of the projection 42a and the internal surface of the aperture 9 or of the bushing 41a, if present, will be suitably smooth to assure a slidable contact surface relation therebetween, to permit the actuator 26a to move rotationally as well as axially relative to the aperture 9 and/or bushing 41a, i.e. as an alternative bearing slide portion to that constituted by the tube free end exterior or interior surface.

It will be seen that in this alternative arrangement, the coil spring 27 may be simply slidably inserted over the projection 42a, and operatively loaded between the adjacent wall portion of the actuator 26a surrounding the projection and the adjacent wall portion of the bearing member 24 as constituted by the latch wall portion 6, or between such adjacent wall portion of the actuator 26a and the shoulder 38a, where present.

The shaft head end 29, as before, extends axially through the aperture 9, constituting the bore of the bearing member 24, and through the axial bore 44a, which in this case spans the distance between the free end of the projection 42a and the crown 43, and is similarly fixed in place by the set screw 46 threadedly inserted in the cross bore 45, which in this embodiment communicates with the axial bore 44a.

Optionally, since there is no axial journal recess in the embodiment of FIG. 5, alternatively, the cross bore 45a and set screw 46a may be provided radially at any suitable circumferential point in the main portion of the actuator 26a, and the crown 43 omitted completely, yet with equally efficient fixing of the shaft head end 29 in the main portion of the actuator 26a.

Furthermore, as shown in the alternative embodiment of FIG. 6, in which corresponding parts to those in FIGS. 1 and 2 are likewise assigned the same reference numerals, the actuator 26b is provided with an axial journal projection or spindle 42b, in place of the axial recess 42, for freely slidable insertion in the bore 25b of the hollow tube 34b as the slide portion.

In this instance, the tube 34b is provided with an external thread portion 37b and the aperture 9 of the latch wall portion 6 in turn with an internal thread portion 9b, so that the tube 34b is simply screwed into the aperture 9 to fixedly mount the same in place.

The axial bore 44b, in this instance also, spans the distance between the free end of the projection 42b and the crown 43b and communicates with the cross bore 45 in the crown 43b in which the set screw 46 is threadedly inserted.

Optionally, the axial bore 44b may be provided with an axially adjustable ferrule connector 29b, fixedly attached to the shaft head end 29 by crimping to provide one or more crimps 29bb or by other suitable attaching means, and located in the axial bore 44b for releasably adjustable selectively fixed connection therein, similarly by the set screw 46 in the cross bore 45 in the crown 43b.

Thus, instead of directly extending through the bore 25b, the shaft head end 29 may be connected to the ferrule connector 29b, and the latter inserted in the bore 25b for axial movement therein to adjust the axial position of the shaft 28, and specifically of the shaft head end 29, with respect to the bore 25, aperture 9, latch wall portion 6 and actuator 26b.

Likewise, optionally, since there is no axial journal recess in the embodiment of FIG. 6, alternatively, the cross bore 45b and set screw 46b may be provided radially at any suitable circumferential point in the main portion of the actuator 26b, and the crown 43b omitted completely, yet with equally efficient fixing of the shaft head end 29 in the main portion of the actuator 26b via the ferrule connector 29b.

In any case, the external surface of the projection 42b and the internal surface of the tube bore 25b, will be suitably smooth to assure a slidable contact surface relation therebetween, to permit the actuator 26b to move rotationally as well as axially relative to the bore 25b within the hollow tube 34b, i.e. for the same purposes as in the case of the other embodiments.

It will be seen that in this alternative arrangement as well, the coil spring 27 may be simply slidably inserted over the projection 42b, and operatively loaded between the adjacent wall portion of the actuator 26b surrounding the projection and the adjacent wall portion of the bearing member 24, i.e. as constituted by the latch wall portion 6 at the margins of the aperture 9, in which the hollow tube 34b is seated at the thread portion 37b.

However, since the actuator 26b is inserted via the projection 42b into the bore 25b in the hollow tube 34b in the embodiment of FIG. 6, rather than directly in the aperture 9, or via the bushing 41a, as in the case of the embodiment of FIG. 5, the actuator 26b may also optionally be provided with an outer annular extension 26bb, radially outwardly spaced from and concentric with the projection 42b.

Such annular extension 26bb will span the axial distance between the adjacent wall portion of the actuator 26b and that portion of the projection 42b outwardly of the aperture 9 as determined by the adjacent portion of the latch wall portion 6 thereat, i.e. corresponding to that axial portion of the hollow tube 34b extending from the latch wall portion 6 to the adjacent facing wall of the actuator 26b.

The resulting intermediate concentric annular recess 42bb defined between the outer annular extension 26bb and the adjacent axial portion of the projection 42b, thus may serve to house the coil spring 27 therein in a manner similar to the disposition of the coil spring 27 in the recess 42 relative to the tube free end 35 of the hollow tube 34 in the embodiment of FIGS. 1 and 2.

A like outer annular extension (not shown) may also be optionally provided on the actuator 26a in the embodiment of FIG. 5 to house the coil spring 27 in the same way, if desired, as the artisan will appreciate.

In all three embodiments, the coil spring 27 is preferably selectively sized to permit relatively free sliding rotational and axial movement between the actuator and the bearing member at the bore, as well as unrestrained and unhindered urging by the coil spring of the actuator to demount the same from the bearing member and place the actuator in the corresponding deactivating position.

In the case of the embodiment of FIGS. 1 and 2, the coil spring 27 is preferably sized to provide the same as a spacer bushing concentrically between the recess 42 and the tube free end 35, while permitting such freely slidable relative rotatable and axial movement between the actuator 26 and the bearing member 24.

Similarly, in the optional case of the inclusion of the recess 42bb in the embodiment of FIG. 6, the coil spring 27 is preferably sized to provide the same as such a spacer bushing concentrically between such recess, or more specifically the annular extension 26bb, and the hollow tube 34*b*, while equally permitting such freely slidably relative rotational and axial movement between the actuator 26*b* and the bearing member as constituted by the hollow tube 34*b*.

Furthermore, in all three embodiments, the crown may be separately formed and then connected to the remainder of the actuator, e.g. by welding or other suitable means, or the actuator may be provided initially as an integral one piece block.

Likewise, in the case of the projection and optional annular extension embodiments (FIGS. 5 and 6), these parts may be separately formed and then connected to the remainder of the actuator in similar manner, or the particular actuator may be provided initially as a one piece block.

The particular actuator, hollow tube, bushing, washer, nut, set screw and coil spring, may be formed from metal or plastic or other equally serviceable material, e.g. by machining, stamping, molding, etc. technique, as the case may be, in conventional manner.

The material used for the coil spring must of course be such that the spring will possess sufficient reserve resilient urging force to remain in operative loaded condition indefinitely without losing its ability to urge the actuator to deactivating position as contemplated herein. The material used for all such parts of course must be such that they will wear well and withstand the forces exerted thereon in use as contemplated herein.

A conventional latch mechanism or body lock 22 is shown in the PRIOR ART FIG. 7 arrangement, as seen for instance looking outwardly from within the vehicle compartment. The latch mechanism 22 is situated in the compartment lid or deck lid of the motor vehicle and includes on the latch back plate or latch wall portion 6 a typical conventional latch release actuator arm 260, pivotally mounted via a central pivot rivet 261 for pivoting about axis A in the receiving aperture or wide bore 9 of the latch wall portion 6.

Actuator arm 260 contains, via the pivot rivet 261, a through slot 262, in which the inner end of the usual rigid flat transmission shaft (not shown) is freely slidably insertedly mounted, with the opposite or outer end of such flat shaft being provided with a hook portion for direct insertion in the rear seat or eye 19 of the lock cylinder 17 of the lock mechanism 11 (cf. FIG. 1).

Also pivotally mounted on latch wall portion 6 is a release system or lever linkage which may take the form of the conventional coacting release arm 47 and locking arm 48, operatively interconnected by the interposed wire spring 49. Release arm 47 is reciprocally displaceably mounted for pivoting about axis C, and locking arm 48 is reciprocally displaceably mounted for pivoting about axis D, under the resilient bias or urging action of spring 49 arranged as a simple dual return spring therebetween.

Axis C and axis D are selectively spaced from each other and from axis A, and such axes are preferably all parallel to each other, as the artisan will appreciate.

Release arm 47 contains a catch portion 50 cooperating with an opposing notch portion 51 and an opposing nose portion 52 on the locking arm 48, to hold the latch portion 53 of the locking arm in locking engagement with a striker 54, suitably stationarily positioned on the vehicle body, under the tension of the return spring 49. In the neutral or rest position of the release system, when the locking arm 48 is in locking engagement with the striker 54 and the lock cylinder 17 is in neutral or rest position in the lock mechanism 11 under the action of the return spring 21 (cf. FIG. 1), in the conventional actuator arm 260 is normally rotationally spaced slightly from the release arm 47.

Hence, upon inserting the key 18 in the lock mechanism 11 and turning the key, e.g. clockwise as viewed from the exterior of the truck lid or deck lid 1 (cf. FIG. 1), or by using one of the three break-in by-pass methods earlier discussed, the actuator arm 260 will be rotated about axis A to the right as viewed in FIG. 7 from its neutral or rest position until it contacts the adjacent portion of release arm 47. Continued pivotal movement of the actuator arm 260 will cause release arm 47 to pivot in the same rotational direction about axis C, against the force of the return spring 49, until the catch portion 50 moves out of the notch portion 51 of locking arm 48, allowing locking arm 48 to rotate about axis D in the opposite direction, i.e. to the left as viewed in FIG. 7, under the force of the spring 49.

Upon such rotation of locking arm 48, the nose portion 52 thereon operatively engages the adjacent edge of the catch portion 50, and the spring 49 causes the latch portion 53 to drop down and away from the striker 54, thereby unlocking the body latch and permitting the trunk lid or deck lid to be opened.

Normally, the underside or outer edge of the locking arm 48 in the intermediate portion between the notch portion 51 and the latch portion 53 is shaped to form a relocking cam 55, and is arranged relative to the striker 54 such that upon closing the trunk lid or deck lid, the locking arm 48 will be rotated in reverse direction, i.e. to the right as viewed in FIG. 7, by engagement of the relocking cam 55 with the striker 54.

This will cause the nose portion 52 to disengage from the catch portion 50 of the release arm 47, and the latch portion 53 to reengage with the striker 54. At the same time, the catch portion 50 of the release arm 47 will reenter the notch portion 51, under the force of the return spring 49, to hold the latch portion 53 in place, i.e. in latching engagement with the striker 54.

Of course, any other latch mechanism release system or lever linkage may be employed to release the latch mechanism 22 from engagement with the striker 54, such as a single release lever latch member (not shown) operatively arranged for actuation by an appropriate actuator arm in conventional manner, as the artisan will appreciate.

The only significance of these parts of the latch mechanism 22 in terms of the present invention is the constructional arrangement of the mounting of the pivotal motion transmission assembly of the present invention therein for releasing the latch, i.e. an actuator in relation to a bearing member, e.g. containing a bore, and with respect to which connection between the actuator and the pivotal force transmitting shaft, attached to the lock mechanism 11, may be operatively attained under the tension of the contemplated urging means operatively interposed between the actuator and the bearing member or latch mechanism.

This may be appreciated from FIG. 8, considered in comparative relation to FIG. 7 in terms of the overall arrangement of FIG. 1. Thus, in FIG. 8, the conventional actuator arm 260 mounted via the pivot rivet 261 in the aperture 9 in the latch back plate or latch wall portion 6 has been omitted from the latch mechanism 22, with all other parts being the same as the corresponding parts shown in FIG. 7 and in FIG. 1, as the case may be.

In this instance, however, the latch back plate or latch wall portion 6 is shown removed from the trunk lid or deck lid 1, and FIG. 8 indicates the location of the bolt holes 7*a* for the bolts 7 used with the nuts 8 to mount the latch back plate or latch wall portion 6 at the large cut out slot 3*b* on the interior lid wall web portion or support plate 3*a* of the interior lid wall 3 (see FIG. 1).

Hence, in the case of a modification or add-on use of the assembly 23 according to the present invention, the conventional actuator arm 260 and pivot rivet 261 are simply removed from the aperture 9, along with the removal of the usual flat transmission shaft.

The actuator 26 is illustrated in FIG. 8 in phantom, operatively mounted at the receiving aperture 9 in accordance with the arrangement of FIG. 1 as explained above. Of course, the alternative arrangement of FIG. 5 as well as that of FIG. 6 is equally illustrated in FIG. 8, in terms of the positional relationship of the particular actuator to the release system or lever linkage, as represented by release arm 47 and locking arm 48 under the action of the return spring 49, for locking engagement of the latch portion 53 with the striker 54, here also shown in phantom, on the vehicle body.

As may be appreciated from FIGS. 3 and 4, the actuator 26 is preferably provided with a selective, preferably simple tear drop, shape. Likewise, preferably the actuator 26*a* of the embodiment of FIG. 5 as well as the actuator 26*b* of the embodiment of FIG. 6 are each also provided with such a selective tear drop shape.

Significantly, the actuator in each instance will be preferably oversized selectively in relation to the lateral or transverse distance between the pivot axis A of the actuator and the pivot axis C of the release arm 47 and the concordant disposition of the facing contact edge of the release arm when in neutral or rest position under the action of the return spring 49, i.e. corresponding to the locked position of the locking arm 48 in locking engagement with the striker 54, such that the adjacent edge portion of the actuator will correspondingly selectively overlap or interfere with such facing contact edge of the release arm 47, i.e. when the actuator is in activating position on the bearing member 24.

The normal neutral or rest position of the pertinent portion of the release arm 47 containing such facing contact edge is shown in phantom in FIG. 8. This corresponds to the position of the release arm 47 shown in FIG. 7. However, upon mounting the particular selectively oversized actuator according to the present invention at the aperture 9, as shown in phantom in FIG. 8, the release arm 47 is slightly rotated to the right, as viewed in FIG. 8, e.g. by simple manual pushing force, to permit the actuator to enter and be operatively positioned in the overlapping or interfering space formerly occupied by the release arm 47.

As a result, the actuator 26 and release arm 47 will be maintained in coactive laterally adjacent relation under the tension of spring 49, more or less in the same plane transverse to axis A and axis C, and relatively at the same axial point on axis A corresponding to the activating position of the actuator as shown in FIG. 1 and at the same time the release arm 47 will be arranged adjacent to yet spaced from the axis A as well as laterally of the tube free end 35.

The slight cocking of spring 49 caused by the slight pivotal displacement of the release arm 47 to the right, i.e. as viewed in FIG. 8, from the phantom position corresponding to that shown in FIG. 7 to the offset position shown in full line, will not significantly alter the operative relation between the release arm 47 and the locking arm 48, nor detract from the desired locking engagement between the locking arm 48 and the striker 54.

Generally, in this regard, sufficient play is inherently provided for, between the coacting parts in such conventional latch release systems or lever linkages, and this will accommodate readily the contemplated slight displacement of the release arm from the phantom position to the full line position as shown in FIG. 8, in accordance with this preferred feature of the present invention.

In particular, despite such slight displacement, the catch portion 50 of the release arm 47 will still remain in full retaining contact with the notch portion 51 of the locking arm 48 sufficiently to prevent the latch portion 53 from dropping down and away from the striker 54, and in turn undesirably unlatching the latch mechanism.

The release linkage arrangement as shown in FIG. 8 in effect contemplates a reciprocally displaceably mounted release arm 47, normally resiliently biased by the return spring 49 to an interfering or overlapping position, as shown in phantom, situated in at least a portion of the space occupied by the particular actuator, e.g. actuator 26, actuator 26*a* or actuator 26*b*, as the case may be, when at the activating position, and such actuator is selectively sized and shaped relative to the size and shape of the release arm, when at the interfering or overlapping position (i.e. each is correspondingly selectively sized and shaped relative to the other), for engagingly displacing the release arm from such interfering or overlapping position when the actuator is operatively mounted on the bearing member 24, i.e. as constituted by the hollow tube 34 (FIG. 1); the aperture 9 and/or optional bushing 41*a* in the latch wall portion 6 (FIG. 5); or the hollow tube 34*b* (FIG. 6); as the case may be, and is disposed at the activating position in the common plane of the actuator and release arm, i.e. transverse to the axis A (cf. FIG. 1).

Of course, any other interfering means may be provided for the desired purposes, as the artisan will appreciate, the only requirement being that upon deviating movement of the actuator from the activating to the deactivating or demounted position, the interfering means be operable to prevent the return of the actuator to the activating position, i.e. to prevent such return or remounting from the outward side of the latch wall portion 6 which faces the lock mechanism 11 and from which direction the tampering to be protected against will be attempted.

Naturally, the resilient force of the return spring 49 and the friction force between the coacting surface portions of the particular actuator and the release arm 47, or the resilient force and friction force of the corresponding parts of any such other interfering means in coacting relation with the actuator must not be sufficient to affect adversely the ability of the actuator to be urged by the urging means to the deactivating or demounted position, as the artisan will appreciate.

Hence, the coil spring 27 or other urging means must inherently possess sufficient reserve force to achieve displacement of the actuator from the activating to the deactivating position, despite any other forces acting on the actuator at the activating position, i.e. upon release of the shaft 28 from its tension attachment disposition relative to the eye 19 of the lock mechanism 11.

In assembling the parts shown in FIG. 2, e.g. as a replacement or add-on assembly, in the latch mechanism 22 shown in FIG. 8, and interconnecting the same operatively with the lock mechanism 11 shown in FIG. 1, to provide a complete lock and latch arrangement according to the present invention, generally the shaft tail end 30 is first coupled with the hook 31 via the collar 33 to form the shaft assembly, suitably crimping the ends of the collar around the facing inserted end portions of the tail end and hook shank 32, to provide respective crimps 33*a* and 32*b* thereat, for example, and then the hook 31 is inserted into the eye 19 of the lock cylinder 17 of the lock mechanism 11, so that the return spring 21 fits around the hook 31 to hold it in place while permitting limited relative play between the hook and the eye 19 (cf. FIG. 1).

On the other hand, the hollow tube 34 is inserted up to the shoulder 38 into the aperture 9 of the latch wall portion 6, created by the removal of the original actuator arm 260 and pivot rivet 261 therefrom (cf. FIGS. 7 and 8), in the direction of the lock mechanism 11 (cf. FIGS. 8 and 1), and then the bushing 41, if used, is slid over the opposite seating end 36 and into the resulting annular space between the aperture 9 and the tube 34, followed by the washer 40 and locking nut 39. The nut 39 is screwed along the thread portion 37 until it firmly locks the complete tube assembly as a unit onto the latch wall portion 6.

Such will be sufficient to withstand normal vibrations encountered during use of the motor vehicle and/or compartment lid, especially where washer 40 is provided as a lock washer, in conventional manner.

Thereafter, the latch mechanism 22 is reinstalled in the trunk lid or deck lid, with the latch wall portion 6 being mounted on the support plate 3*a* via the bolts 7 and nuts 8 (cf FIGS. 8 and 1), and the lock mechanism 11 with the shaft assembly attached is reinstalled in the lock opening 10, the lock case 16 being held in palce by the lock retainer 13 upwardly inserted through the slot in the interior lid wall 3 and attached thereat via the retainer screws 15. The shaft head end 29 is then freely passed through the center bore 25 in the hollow tube 34 in the direction from the tube seating end 36 to the tube free end 35.

The coil spring 27 is then installed over the smooth exterior surface of the tube free end 35 up to the shoulder 38, and the actuator 26 is inserted or in effect threaded over the shaft head end 29, protruding from the bore 25 at the tube free end 35, via the axial bore 44 until the shaft head end 29 protrudes from the crown 43. The axial recess 42 will thereby enclose concentrically the coil spring 27 and the adjacent portion of the tube free end 35 up to the shoulder 38, and compress the coil spring within the recess.

This will load the spring operatively between the actuator 26, i.e. the facing interior wall of the crown 43 defining the inner end or transverse bottom wall or floor of the recess, and the bearing member 24, i.e. the hollow tube 34, or more particularly the shoulder 38.

Finally, any slack in the interconnection is taken up by further pulling of the shaft head end 29 outwardly axially from the axial bore 44, so that the shaft 28 will be under full tension between the eye 19 of the lock mechanism 11 and the actuator 26 of the latch mechanism 22 as caused by the urging force of the coil spring 27, without undue binding between the rotatably contacting parts, i.e., between the adjacent wall of the actuator 26 and the shoulder 38.

When in such position, the set screw 46 is tighted in the threaded cross bore 45 in the crown 43 until it seats securely against the shaft head end 29 in the axial bore 44. This will secure the actuator 26 and coil spring 27 in place, with the shaft 28 under adjustably slight tension, to provide the arrangement as shown in FIG. 1.

Favorably, the force of the compression coil spring 27, slidably mounted on the smooth tube free end 35 and axially loaded between the actuator 26 and the shoulder 38, will maintain these relatively rotatable parts slightly apart to relieve any binding or undue friction therebetween during normal lock operation, depending on the overall tension adjustment of the shaft 28.

Naturally, the opposing slide contact surface portions of the actuator 26 and shoulder 38 should be suitably smooth, whereby to reduce friction and permit free sliding therebetween. The same is true of the recess 42 and the external slide surface of the tube free end 35 relative to the opposing composite internal and external surfaces of the coil spring 27 interposed concentrically therebetween, as well as of the facing surface of the crown 43, which defines the bottom wall or floor of the recess 42, and the opposing annular surface at the end of the tube free end 35 where these portions are axially sized for sliding contact.

As will be appreciated, the actuator 26*a* and actuator 26*b* will be installed in corresponding manner to provide the arrangements shown respectively in FIGS. 5 and 6.

In the case of the alternative optional inclusion of the axially adjustable ferrule connector 29*b* as shown in the axial bore 44*b* in FIG. 6, this of course is initially attached to the shaft head end 29 as by crimping to provide one or more crimps 29*bb* in the ferrule connector, i.e. in making up the shaft assembly of the shaft with the collar 33 and hook 31. The connector 29*b* is then merely freely inserted through the bore 25 in the mounted hollow tube 34 and passed through the axial bore 44*b* in the actuator 26*b*, and held in place by the set screw 45 in the same selectively releasably adjustable way as discussed above.

Understandably, in all appropriate cases the shaft will normally have a selective length sufficient to span operatively the linear distance from the eye 19 of the lock cylinder 17 to the exterior of the crown 43 when the actuator is in activating position, and will usually be provided with a slight excess in length, so that the shaft head end 29 may be readily passed through the actuator and protrude from the axial bore in the crown. The excess shaft length, if too long, can be cut off in conventional manner.

As will be appreciated from the foregoing, the shaft 28 may be provided as a rigid shaft or rod suitably interconnected via the collar 33 with the hook 31, such that the shaft head end 29 constitutes a readily seatable portion in the axial bore 44 which may be effectively held in place by the set screw 46, e.g. in similar manner to the connection of the set screw with the ferrule connector 29*b*. By providing the shaft tail end 30 with a suitable hook 31 integral therewith (not shown), e.g. by molding, bending or deforming the shaft tail end 30 into the shape of an open hook, the collar 33 and separate hook 31 may be omitted.

In this regard, however, while such a rigid shaft arrangement is generally usable where the axis A along which the shaft 28 extends and the axis B of the lock cylinder 17 coincide, the use of such a rigid shaft is generally not usable where the axis B of the lock cylinder 17 intersects the horizontal plane in which the axis A is disposed.

This is because the hook 31 or its rigid counterpart on the rigid shaft will not provide sufficient free play or articulation at the eye 19 of the lock cylinder 17 to permit the lock cylinder 17 to rotate without objectionable binding at the hook 31 and in turn at the mounting assembly of the actuator on the bearing member, i.e. when normally opening the lock with the key 18.

In such instance, a separate hook will usually be required which must be connected to the shaft by a universal joint mechanism (not shown) to accommodate the offset angle of the axis B relative to the axis A, or at least a portion of the shaft must be provided of flexible material, inherently constituting such a universal joint and thereby permitting the shaft to be displaced from its normal longitudinal axis, yet without detriment to the pivotal force transmitting ability of the shaft to effect pivoting of the actuator in immediate response to the rotation of the lock cylinder 17 for releasing the latch mechanism 22 for opening the compartment lid in the normal instance.

For this reason, it is particularly preferred instead to provide the entire operative length of the shaft as a flexible shaft, i.e. freely or readily locally flexibly displaceable from its normal, e.g. longitudinal, axis, and especially one capable of performing the desired pivotal force transmission yet substantially incapable of significant axial elongation or longitudinal stretching under the contemplated level of tension applied thereto by the urging means, e.g. coil spring 27.

In particular, such flexible shaft should be substantially incapable of significant tortional twisting or rotational displacement of one end thereof relative to the other along its length in any position of flexible displacement from its normal longitudinal axis, when mounted operatively between the eye 19 of the lock cylinder 17 and the actuator 26 under the force of the urging means, e.g. coil spring 27. Otherwise, undesirable play may be introduced into the linkage interconnection so as to defeat the basic purpose of the lock mechanism and shaft to operate the latch mechanism.

By employing such a flexible shaft, the assembly may be incorporated advantageously in any lock and latch arrangement, whether the lock cylinder axis B coincides with the latch actuator axis A, or intersects the horizontal plane in which such axis A is disposed, because the flexible shaft will automatically adjust to any misalignment between the lock mechanism 11 and the latch mechanism 22. Hence, the assembly 23 may be adapted to any motor vehicle model.

Suitable flexible shafts are well known, and these include the usual multifilament or multistrand flexible cables widely used in the auto industry as control cables, etc. These flexible cables are usually made of metal such as steel, but any flexible cable, whether made from metal or plastic, may be used for the shaft according to the present invention, so long as it will not stretch or undergo tortional twisting in terms of the above explanation, and thus so long as it will capably perform the necessary pivotal force transmission function contemplated, preferably at all prevailing temperatures, including those below freezing and those encountered in extremely hot weather, without failure or undue wear over its intended prolonged useful life.

Similarly, the rigid rod form of shaft, as well as the collar 33 and hook 31, plus the alternative optional ferrule connector **29*b***, may each be made of metal or plastic, and be formed by any suitable means, as the artisan will appreciate, again so as not to permit stretching or tortional twisting in terms of the aforesaid explanation, of the overall shaft assembly, yet be functional at all prevailing temperatures, without failure or undue wear over the intended prolonged useful life of the individual parts.

Of course, due to the nature of the individually interconnectable portions of the shaft assembly, the same lends itself to simple and inexpensive replacement of only those elements in the train of tandem parts from the hook to the shaft head end 29, or to the ferrule connector **29*b***, if present, which may need replacement, without having to replace the entire assembly just because of the failure of one such element.

Nevertheless, because of the overall tamper deactivating purpose of the basic pivotal motion transmission assembly 23 according to the present invention, it is preferred to make a comparatively weak link connection among the elements in the train of parts in the shaft assembly.

More specifically, it is desirable to make either the hook 31 itself, or the collar 33 itself, or the crimp **2*b* or the like interconnection between the hook shank 32 and the collar, or the opposite crimp 33*a* or the like interconnection between the collar 33 and the shaft tail end 29, or, where present optionally, the ferrule connector 29*b* itself or the crimp 29*bb* or the like interconnection between the shaft head 29 and the ferrule connector 29*b*, or even the set screw 46**, of selectively slightly weaker construction than the remainder of the parts.

In this way, if excessive or gross tampering longitudinal stress is placed on the shaft assembly, the same will selectively locally break its operative connection with the actuator 26 at such predesignated selectively weaker link as the weakest link in the transmission linkage between the lock mechanism 11 and the latch mechanism 22. This will per se automatically cause the urging means, e.g. coil spring 27, to displace the actuator 26 off of the tube free end 35 to deactivating or dismounted position, with a minimum degree of resulting damage to the overall arrangement from this specific cause.

As will be appreciated, as the case may be, the bore 25 in the hollow tube 34 and the axial bore 44 in the actuator 26 according to the embodiment of FIGS. 1 and 2; the axial bore **44*a* in the actuator 26*a* according to the embodiment of FIG. 5; and the axial bore 44*b* in the actuator 26*b* according to the embodiment of FIG. 6; will be selectively sized in inside diameter relative to the outside diameter of the shaft head end 29, and relative to the outside diameter of the ferrule connector 29*b***, where optionally present, so as to permit the shaft to be readily inserted into and freely passed through each of such axial bores without frictional resistance.

Preferably, an annular clearance gap should be provided between the exterior of the shaft 28 and the ferrule connector **29*b***, as the case may be, and the surrounding internal surface of the bore in the actuator housing the same, to facilitate the insertion and axial preseating displacement of such shaft or ferrule connector therein, although a snug or friction fit between these concentric parts is generally not objectionable except to the extent of the difficulty in achieving the assembling of these parts together.

Specifically, the shaft may still be effectively passed through the actuator bore, for instance, even when there is a snug or friction fit therebetween, by simply twisting or rotating the actuator to thread the same in effect over the shaft head end while applying a slight axial pressing or pushing force against the shaft. Since the shaft, whether rigid or flexible, must not undergo tortional twisting, the actuator will eventually travel along the shaft to reach the desired position as described above, and as shown in FIG. 1, as well as in FIG. 5 and in FIG. 6, as the case may be.

However, in the case of the bore 25, aperture 9, bushing 41*a*, and bore 25*b*, a significant clearance gap must be maintained between the internal surface of each of these parts, as the case may be, and the external surface of the shaft 28, to permit free and unhindered sliding axial movement of the shaft under the urging force of the coil spring 27 in the direction from the lock mechanism 11 to the latch mechanism 22, when tampering is experienced, so that the corresponding actuator will be immediately displaced by the coil spring 27 to demount the actuator from the bearing member 24, whereby to insure the fulfilment of the tamper deactivating purposes of the present invention (cf. FIG. 1).

A review of the operative mounting relation between the particular actuator and the particular bearing member according to the present invention, will show that in fact the operative configuration of the journal surface on the actuator and the coacting bearing slide surface on the bearing member may be suitably selectively varied as desired, so long as a bore or other arrangement is provided in or at the bearing member for permitting an operative connection between the actuator and the shaft, e.g. axially via the axial bore in the bearing member.

In effect, the preferably flexible cable is housed in the composite hole through the center of the actuator and preferably also in the bearing member, constituted by the axial bore 44 or 44*a* or 44*b* and the tube bore 25 or 25*b*.

While the shaft generally extends through the bearing bore, i.e. via a necessary clearance gap spacing relationship therebetween, in the embodiments of FIGS. 1 and 5, this need not be the case in the embodiment of FIG. 6 where the ferrule connector 29*b* is optionally present and its length relative to the axial bore 44*b* in the actuator 26*b*, or relative to the length of the shaft itself, is such that the ferrule connector 29*b* extends axially beyond the aperture 9 and the latch wall portion 6 in the direction of the lock mechanism 11, i.e. while still providing the required clearance gap spacing between the shaft and bearing bore.

However, the desire for an operative axial connection between the actuator on one side of the latch wall portion 6 remote from the lock mechanism 11 and the shaft extending to the actuator from the lock mechanism on the other side of the latch wall portion, normally dictates the requirement for the presence of a bore axially through the bearing member for the purposes of the present invention.

Otherwise, a less desirable and more cumbersome rigid rod type shaft must be used having an axially and radially offset or crank shaped portion type shaft head end 29*a* operatively arranged and connected to the body of the actuator for relative rocking rotational displacement or movement of such crank shaped portion head end along a curved path 6*a* radially spaced from yet concentric to axis A as well as tamper deactivating axial displacement or movement generally parallel to axis A via a corresponding radially offset curved slot 6*b* in the adjacent extension portion 6*c* of the interposed latch wall portion 6 thereat, as shown in phantom in FIG. 8, or where such extension portion 6*c* is absent, operatively arranged and connected to the body of the actuator for such displacement or movement across the adjacent edge of the latch wall portion 6 thereat, as the case may be.

Hence, while it is preferred to provide a bore containing bearing surface for the bearing member and a complemental bore containing journal surface for the actuator defining a flat and smooth sliding contact composite annular interface therebetween in the form of a hollow cylinder; e.g. the external axial surface of the tube free end 34 and the internal axial surface of the recess 42 in relation to the coil spring 27 as a functional spacer bushing concentrically therebetween in the embodiment of FIG. 1; or the external axial surface of the projection 42*a* and the internal axial surface of the receiving aperture or wide bore 9 in the latch wall portion 6 in direct relation to each other or in relation to the optionally interposed bushing 41*a* concentrically therebetween in the embodiment of FIG. 5; or the external axial surface of the projection 42*b* and the internal axial surface of the hollow tube 34*b* in direct relation to each other in the embodiment of FIG. 6; any other suitable form of composite annular bearing interface may be used.

For example, the coacting parts may be of opposed convex and concave rounded surface shape to provide a corresponding hollow hemispherical or more specifically frusto-hemispherical composite annular bearing interface, or may be of opposed convex and concave straight or funnel surface shape to provide a corresponding hollow conical or more specifically frusto-conical composite annular bearing interface, or the like. All such configurations, especially those through which an axial bore is desirably provided to accommodate most efficiently the operative connection between the actuator and the shaft at the latch wall portion 6, are therefore contemplated according to the present invention.

Critical, however, to the operation of the present invention is the requirement that the shaft in all such constructions be freely slidable or displaceable, and especially rotatable within and axially or longitudinally displaceable through the bore in the surrounding bearing member with sufficient annular clearance therebetween along their common extent, to permit immediate and unhindered release of the essentially slidably mounted actuator from the activating position under the force of the urging means and immediate and unrestrained deviating movement of the actuator to the deactivating position under such urging means force, e.g. to demount the actuator from the bearing member.

In this regard, it will be appreciated that the urging means may be provided in any appropriate form and in any operative position in direct or indirect force imparting urging relation between the movable or demountable actuator and the stationary bearing member, sufficient for urging, e.g. unilaterally, the actuator from the activating position in coacting relation with the release linkage to the deactivating position or demounted position out of coacting relation with the release linkage.

While such urging means are preferably provided as resilient urging means in the form of a compression coil spring, they may also be provided in the form of a tension coil spring or a corresponding compression leaf spring or tension leaf spring, appropriately loaded between the pertinent parts for urging the actuator to deactivating position, as aforesaid.

Consequently, as may be appreciated from FIGS. 1, 5, 6 and 8, a tamper deactivating pivotal motion transmission assembly 23 is provided according to the present invention, for incorporation as a modification or add-on unit or kit, or as part of the original assembly of a lock and latch arrangement.

The latch mechanism 22 thus includes a pivot bearing slide portion containing bearing member 24, e.g. hollow tube 34 (FIG. 1), or latch wall portion 6, including bushing 41*a* where present (FIG. 5), or hollow tube 34*b* (FIG. 6); having an inward side or facing side, i.e. adjacent the actuator, and an outward side or opposite side, i.e. remote from the actuator; and preferably containing an open ended bore therethrough substantially concentric to the pivot axis A, e.g. correspondingly internal central bore 25 in hollow tube 34 (FIG. 1), receiving aperture 9 in latch wall portion 6 (FIG. 5), or internal central bore 25*b* in hollow tube 34*b* (FIG. 6), i.e. as opposed to a crank portion shaft head end 29*a* arrangement; and a release linkage adjacent to the axis A to unlatch the latch mechanism 22, e.g. release arm 47 and locking arm 48.

The lock mechanism 11 is disposed at a selectively remote reference point spaced from the latch mechanism 22, e.g. in the lock opening 10 at the exterior lid wall 2; and includes a pivotal force applying portion, e.g. lock cylinder 17.

The actuator 26 or 26*a* or 26*b* is operatively mounted on the bearing member at the inward side thereof for pivotal movement of the actuator about the axis A at an activating position (cf. FIGS. 1, 5 and 6 plus FIG. 8), and is selectively sized and shaped for coacting relation with the release linkage at the actuating position (cf. FIGS. 3, 4 and 8), for actuating the release linkage to unlatch the latch mechanism 22. The actuator is also operatively arranged for deviating, e.g. axial, movement of the actuator out of operatively mounted relation with the bearing member and out of coacting relation with the release linkage to a deactivating position, e.g. demounted from the bearing member.

The urging means, e.g. resilient urging means such as the compression coil spring 27, are operatively arranged between the actuator and the latch mechanism 22 for urging the actuator to the deactivating position.

Lastly, the pivotal force transmitting linear tension shaft 28 has its head end 29, e.g. preferably extending through the bore 25 or aperture 9 or bore 25*b* (FIGS. 1, 5 and 6, respectively), substantially operatively, e,g. axially, connected to the actuator for conjoint movement of the actuator and shaft relative to the bearing member, such bore, and the release linkage. The shaft tail end 30 is disposed at the outward side or opposite side of the bearing member and correspondingly remote from the actuator and bearing member, and is attached under tension to the pivotal force applying portion, e.g. the lock cylinder 17, of the lock mechanism 11 at the remote reference point.

This arrangement of the shaft 28 will maintain the actuator at the activating position against the force of the urging means, e.g. coil spring 27, and will permit the shaft to receive a pivotal force applied to the shaft tail end 30, e.g. by the lock cylinder 17, for pivoting the shaft and actuator to unlatch the latch mechanism 22. Therefore, upon disturbing the tension attachment disposition of the shaft tail end 30 at or relative to the lock mechanism 11, the urging means will urge the actuator to deactivating position, e.g. the coil spring 27 will move the actuator axially away from the bearing member until it demounts therefrom.

Advantageously, the assembly 23 may be located in the motor vehicle for locking the compartment lid 1 thereon, such that the corresponding vehicle exterior wall 2 contains the lock opening 10, and the corresponding vehicle interior wall 3 is spaced inwardly from the exterior wall, with the lock mechanism 11 disposed in the lock opening 10 at the exterior wall 2 and the latch mechanism 22 disposed at the interior wall 3 and including the wall portion 6 provided with the bearing member 24 and preferably with the bore 25 or aperture 9 and bore 25*b*, as the case may be.

Clearly, the provision for a shaft having a substantially curved, e.g. continuously curved or rounded, and preferably circular, cross section, and the provision for a flexible shaft, as well as the provision for interfering means such as a selectively oversized actuator in relation to the size and disposition of the release arm 47 of the conventional release linkage when at interfering or rest position, are all of significant benefit in foiling attempts at break-in according to the above discussed three lock by-pass break-in methods.

In this regard, upon disturbing the tension attachment disposition of the tail end 30 at or relative to the lock mechanism 11, such as in gaining access through the lock opening 10 by prying the lock mechanism 11 out from the exterior wall 2 or by driving the lock mechanism 11 inwardly through the exterior wall, the urging means 27 will urge the actuator to demount the actuator from the bearing member, and thus become disengaged from the release arm 47 and prevent the unlatching of the latch mechanism, and in turn the release arm 47 will be displaced to the interfering position to prevent the remounting of the slightly oversized actuator on the bearing member.

On the other hand, upon driving a tool through the vehicle exterior wall 2 in an attempt to apply a tangential torque directly to the shaft to pivot the actuator for unlatching the latch mechanism 22, the flexible nature and curved cross section of the shaft will prevent such attempt from succeeding.

At most, such attempts will cause the weakest link in the shaft assembly to break away from the adjacent parts, i.e. either the shaft 28 itself or the collar 33, hook 31 or ferrule connector 29*b* where present, or even the inner end of the set screw 46, where a longitudinally outward gross tampering force is exerted thereon, plus possible piercing or tearing damage to the exterior wall 2 at the lock opening 10 and/or to the retainer 13 and/or direct damage to the lock mechanism 11, whether the tampering force is exerted outwardly or inwardly.

More specifically, as to the first key lock by-pass break-in method, any probe driven through the compartment lid 1 and contacting the, preferably round rod or round flexible cable type, shaft 28 will accomplish nothing but perhaps the breaking of the shaft assembly away from the key lock or lock mechanism 11.

If the latter does occur, the tension interconnection will be broken. This will cause the coil spring 27 to be relieved of the compression forces acting thereon, and to change from its static condition and stable compressed potential force state to a dynamic condition and unstable axially expanding kinetic force state. This will in turn immediately cause the coil spring 27 to push the actuator off of the tube 34 (FIG. 1) or 34*b* (FIG. 6) or out of the wall portion aperture 9 (FIG. 5), to demount the actuator and place the same out of alignment with the release arm 47 of the body lock or latch mechanism 22, rendering the lock and latch arrangement inoperable, i.e. tamper deactivated.

As to the second key lock by-pass break-in method, if the key lock or lock mechanism 11 is pried out of the lock opening 10 of the compartment lid 1 by whatever means, the shaft assembly will become disconnected from the lock mechanism 11, e.g. by breaking away from the lock mechanism 11 at the weakest point in the interconnected train of parts therewith. As in the first break-in method, this will immediately cause the coil spring 27 to push the actuator off of the tube or out of the wall portion aperture, to demount the actuator and place the same out of alignment with the release arm 47 of the body lock or latch mechanism 22, likewise rendering the lock and latch arrangement inoperable, i.e. tamper deactivated.

As to the third key lock by-pass break-in method, if the key lock or lock mechanism 11 is forced or hammered inwardly through the lock opening 10 of the compartment lid 1 by whatever means, the tension interconnection will be similarly broken, since the lock mechanism 22 and the interconnected train of parts in the shaft assembly will necessarily separate from the exterior wall 2 of the compartment lid, i.e. in terms of the original outward position of the lock mechanism in the exterior wall. As in the first and second break-in methods, this will immediately cause the coil spring 27 to push the actuator off of the tube or out of the wall portion aperture, to demount the actuator and place the same out of alignment with the release arm 47 of the body lock or latch mechanism 22, again rendering the lock and latch arrangement inoperable, i.e. tamper deactivated.

By desirably providing the actuator as a slightly, e.g. peripherally, oversized element or block, preferably of more or less conveniently formable tear drop shape, the actuator when in place on the tube or in the wall portion aperture will hold the release arm 47 slightly opened or away from its normal resiliently biased closed position of reciprocal displacement relative to the locking arm 48.

Hence, upon demounting the actuator, it will become disengaged from the release arm and the release arm will be resiliently biased to its normally closed position and thus enter at least a portion of the space formerly occupied by the actuator, making it impossible from the outside of the compartment lid 1 to replace the actuator on the tube or in the wall portion aperture, i.e. even if the shaft or the lock mechanism 11 still connected to the shaft could be pulled outwardly in an attempt to remount the actuator on the tube or in the wall portion aperture or otherwise, e.g. in either the bore containing embodiments or the crank portion shaft head end 29*a* embodiment, as the case may be.

More specifically, despite possible access to the interior space of the compartment lid 1 through the lock opening 10 by prying out or hammering in the lock mechanism 11 or even through a separate hole by puncturing the exterior lid wall 2, the would-be thief would be faced at best with an open bore in the hollow tube or an open wall portion aperture. The insertion of a tool therethrough would be ineffective for engaging the release arm 47 sufficiently to displace the release arm to its locking arm releasing position.

Understandably, the ratio of the axial length to the inside diameter width of the tube bore or of the wall portion aperture, and/or the ratio of the inside diameter width of such tube bore or wall portion aperture to the radial length or distance between the axis A and the closest adjacent edge of the reciprocating release arm thereto when at its locking arm releasing position, should be selected such that, in any position of movement of a tool insertable through the tube bore or wall portion aperture to the side of the latch wall portion 6 at which the release arm is disposed, such tool will be spaced from such closest adjacent edge of the release arm when at its locking arm releasing position (see FIGS. 1 and 8).

Stated another way, the distance between the nearest edge of the tube bore or of the wall portion aperture and the closest adjacent edge of the release arm thereto when at its locking arm releasing position, should be selected in relation to the size and especially the inside diameter width of the bore or aperture such that, in any position of movement of a tool, insertable through the bore or aperture to the side of the latch wall portion 6 at which the release arm is disposed, such tool will be spaced from such closest adjacent edge of the release arm when at its locking arm releasing position.

More specifically, the shortest distance on a line intersecting (1) the center of the tube bore or wall portion aperture, (2) the adjacent end edge of the tube bore or wall portion aperture, and (3) the closest point on the adjacent edge of the release arm when at its locking arm releasing position in relation to such end edge of the tube bore or wall portion aperture, and measured between a tangent to such adjacent end edge of the tube bore or wall portion aperture and such closest point thereto on the release arm at such releasing position, should be selected, in relation to the ratio between the axial length and inside diameter width of the tube bore or wall portion aperture, such that in the deactivated or demounted position of the actuator as well as in any position of movement of a tool insertable or inserted through the bore or aperture to the side of the latch wall portion 6 at which the release arm is disposed, such tool will be spaced from such closest point on the adjacent edge of the release arm when at its locking arm releasing position, i.e. such tool will be spaced a corresponding distance exceeding such shortest distance.

Such will per se prevent any such tool, inserted from the outward or opposite side of the latch wall portion 6 through the tube bore or wall portion aperture, from releasing the latch mechanism.

As will be appreciated, the instant assembly 23 is equally usable whether the lock and latch arrangement is located on the moving or hinged door part, e.g. the compartment lid or trunk lid or deck lid of a motor vehicle, and the cooperating striker is located on the stationary or door jamb part, e.g. the body of the motor vehicle, or conversely the lock and latch arrangement is located on the stationary part and the cooperating striker is located on the moving part.

In the latter case, for instance where the lock opening 10 and lock and latch arrangement are in the corresponding stationary exterior body wall of the motor vehicle and the striker is on the moving compartment lid thereof, the overall arrangement will still prevent key lock by-pass break-in by the foregoing three break-in methods, in the same way as where the orientation of the parts is reversed as shown in FIG. 1.

Clearly, the association and relationship of the coacting parts is such that, regardless of the weather, climate, temperature or changes therein, the lock mechanism and latch mechanism containing the instant tamper deactivating pivotal motion transmission assembly will operate efficiently for the normal purposes desired, yet will be immediately deactivated upon tampering with the lock mechanism or transmission shaft, and thereby will prevent the opening of the compartment door or lid in question, even though access is gained to the tube bore or latch wall portion aperture, all without the need for special reinforcement or armor protection around the vulnerable accessible areas of the arrangement.

Although after such deactivation, authorized entry to the locked compartment will be equally prevented, valuable items contained therein, including not only those having extrinsic or commercial value but also those having intrinsic or personal value or which may be irreplaceable, will remain intact. However, since after a successful break-in of a conventional lock and latch arrangement, a locksmith would be consulted anyway to repair the break-in damage in the surrounding wall area and/or replace the lock mechanism and/or transmission shaft, such access in the case of an attempted but unsuccessful break-in of the instant tamper deactivating pivotal motion transmission assembly, would only be delayed until such locksmith is consulted.

On the other hand, the compartment lid of a motor vehicle can still be unlatched from the rear seat opening in the car, if desired, without having to first consult a locksmith, as will be noted more fully hereinafter.

Moreover, since the instant assembly is not only designed for incorporation as an original unit in the lock and latch arrangement, but also as an add-on unit or replacement unit for existing conventional equipment, and more specifically because of the versatile nature and arrangement of the individual elements of the instant assembly as an original unit or as an add-on or replacement unit, and the ability to replace only that part or those parts thereof damaged in consequence of any such break-in attempt, and/or to modify the existing structure at the latch wall portion aperture after a successful break-in of existing conventional equipment to accommodate the pertinent parts of the instant assembly as such add-on or replacement unit, the achievement of the present invention may be effected on a do-it-yourself basis without the need for a locksmith.

Aside from repairing any hole punctured in the adjacent exterior wall consequent the first break-in method, and repairing the adjacent area of the exterior wall around the lock opening consequent the second or third break-in method, which may or may not require the aid of a locksmith or general repairman, e.g. an automotive body repairman in the case of a motor vehicle compartment lid lock and latch arrangement, the only other repair will concern the lock mechanism or the shaft assembly train of interconnected parts (see FIG. 1).

As to these and for opening the compartment lid, of course access must be gained to the interior side of the latch from within the compartment space itself.

More specifically, in the case of a motor vehicle trunk compartment, this is readily possible once the vehicle door is unlocked, by removing the rear seat to expose the compartment from within the car and extending a long rod or the like to the release arm through the large cut out slot 3*b* in support plate 3*a* (cf. FIG. 1). A slight push on the release arm in the direction to the right as viewed in FIG. 8, i.e. counterclockwise, will release the locking arm from the striker to open the compartment lid in the normal way, without first having to consult a locksmith.

Hence, if the lock mechanism 11 and/or the retainer 13 are damaged, these may be replaced by readily available parts (see FIG. 1). If any part of the shaft assembly is damaged only that part or those parts so damaged need be replaced (cf. FIG. 2). However, since the entire shaft assembly may be made from comparatively inexpensive materials, it may be more desirable simply to replace the entire shaft assembly by a new one. The only other possibly replaceable part would be the set screw in the actuator used to fix the head end of the shaft in place, or if this were to become jammed in the actuator, possibly both of these parts would need to be replaced.

All such parts of the instant assembly would be incorporated in the lock and latch arrangement in the manner earlier described. All this may be done on a do-it-yourself basis without the need of a locksmith.

Significantly, by providing one of the parts in the train of interconnected parts in the shaft assembly or the set screw in the actuator as a weakest link part, only that part would need to be replaced, aside from any repair and/or replacement of the lock mechanism, retainer and/or exterior wall area, due to gross damage consequent a break-in attempt under the aforesaid first, second or third break-in methods, as the case may be.

For instance, the set screw may be fashioned as a shear pin designed to break off at its extreme end portion or tip under gross longitudinally outwardly directed forces acting axially on the shaft, or may simply be screwed in sufficiently to make contact with the shaft, preferably a flexible shaft, and to fix the shaft against the opposing interior surface portion of the actuator axial bore under a compression adequate for the shaft to transmit torque to the actuator for the release linkage to open the latch mechanism 22 under normal key operated forces at the lock mechanism 11, but inadequate to resist such gross longitudinally outwardly directed break-in forces acting axially on the shaft.

Preferably, however, the shaft assembly itself is provided with such weakest link part such as at one of the two optional crimped ends of the collar 33 or at the optional crimped end of the ferrule connector 29*b* connected to the shaft head end 29.

For instance, by providing an axially extending crimp 33*a*, or a plurality of circumferentially spaced apart axially spaced apart crimps, located on the end of the collar 33 adjacent the shaft tail end 30 (see FIG. 1), and radially inwardly directed into crimping seating engagement with the adjacent portion of the shaft tail end 30 inserted into that end of the collar 33, the shaft will be strongly secured against relative rotational displacement with respect to the collar.

This will insure adequate pivotal force transmission from the lock cylinder 17 to the actuator through the shaft without failure of the connection. However, an axial crimp of this type will be suitably selectively weak as an axial connection, such that upon exerting gross pulling forces directly on the shaft in the portion between the latch mechanism and the collar, or indirectly through the collar and hook, such as by prying the lock mechanism 11 out of the lock opening 10, such suitably axially weak connection will conveniently fail, separating the shaft tail end 30 from the collar 33.

The coil spring 27 will thereupon immediately demount the actuator and deactivate the assembly in the desired manner.

As a result, insofar as the instant assembly is concerned, the only repairable or replaceable part in such instance will be the collar 33. If made from suitable deformable material, such as conventional soft or crimpable metal of thin wall tubing type, e.g. brass or aluminum, the same collar 33 may even be reused if not too deformed, by reinserting the shaft tail end 30 thereinto and applying a new axially extending crimp 33*a* thereat in the same manner.

Favorably, because of the normally protected disposition of the instant assembly 23 within the closed compartment, and the simple pivotal and longitudinal or axial sliding coaction of the parts under the force of the urging means, the assembly is not affected by changes in temperature, weather or climate, and will immediately deactivate the lock and latch arrangement in wet or dry weather, and at freezing or hot temperatures, with equal effect upon tampering therewith as above discussed, and with ready and inexpensive repairing of the damaged part or parts normally without the need of a locksmith, and without having to resort to special structural or armor type reinforcement protecting means to prevent break-in.

It will be appreciated that the foregoing specification and accompanying drawings are set forth by way of illustration and not limitation, and that various modifications and changes may be made therein without departing from the spirit and scope of the present invention which is to be limited solely by the scope of the appended claims.

What is claimed is:

1. Tamper deactivating pivotal motion transmission assembly comprising a bearing member having an inward side and an outward side, and including a wall portion containing an open ended bore substantially concentric to an axis and extending through the member from one side to the other side of the member, and further including a hollow tube portion on the wall portion having a tube free end at the inward side of the member and projecting from the wall portion along the axis in a direction away from the outward side of the member, with the tube portion containing the bore as an open ended internal bore therethrough, an actuator operatively freely slidably mounted on the projecting tube free end and substantially concentric to the bore for pivotal movement about the axis at an axial activating position on the tube free end and for deviating axial movement from the axial activating position to a deactivating position off of the tube free end and out of operatively mounted relation therewith, resilient urging means arranged for urging the actuator off of the tube free end to the deactivating position, and a pivotal force transmitting shaft of substantially curved cross section having a head end substantially axially operatively connected to the actuator for conjoint movement of the actuator and shaft relative to the member, and a tail end at the outward side of the member and selectively remote from the actuator and member and arranged for attachment under tension at a corresponding remote reference point for maintaining the actuator at the axial activating position against the force of the urging means and for receiving a pivotal force applied to the tail end at the reference point for pivoting the shaft and actuator, whereby upon disturbing the tension attachment disposition of the tail end at or relative to the reference point the urging means will urge the actuator to the deactivating position.

2. Assembly of claim 1 wherein the shaft is a flexible shaft which is locally flexibly displaceable from its normal longitudinal axis and when arranged under tension is substantially incapable of tortional twisting along its length in any position of local flexible displacement from its normal axis.

3. Assembly of claim 1 wherein a latch mechanism is provided which includes a release arm at the inward side of the member and adjacent to the axis and laterally of the tube free end to unlatch the latch mechanism, a lock mechanism is provided at a selectively remote reference point spaced from the latch mechanism and which includes a pivotal force applying portion, the actuator is operatively arranged on the tube free end at the axial activating position and laterally adjacent to the release arm and selectively sized and shaped for coacting relation at the axial activating position with the release arm for actuating the release arm to unlatch the latch mechanism upon pivotal movement of the actuator about the axis, and also operatively arranged under the force of the urging means for deviating axial movement out of coacting relation with the release arm when the actuator is urged to the deactivating position, and the tail end is operatively attached under tension to the pivotal force applying portion of the lock mechanism at the reference point for thereby maintaining the actuator at the axial activating position against the force of the urging means and for thereby receiving a pivotal force applied to the tail end for pivoting the shaft and actuator for actuating the release arm to unlatch the latch mechanism, whereby upon disturbing the tension attachment disposition of the tail end at or relative to the lock mechanism the urging means will urge the actuator to the deactivating position.

4. Assembly of claim 3 wherein the tail end is articulatedly attached to the pivotal force applying portion of the lock mechanism.

5. Assembly of claim 3 wherein the release arm is reciprocally displaceably mounted and normally resiliently biased to an interfering position situated in at least a portion of the space which is otherwise normally occupied by the actuator when at the axial activating position, and the actuator is selectively sized and shaped relative to the release arm for engagingly displacing the release arm when the actuator is operatively mounted on the tube free end and disposed at the axial activating position, whereby upon movement of the actuator from the axial activating position to the deactivating position the release arm is biased into the interfering position to prevent the return of the actuator to the axial activating position.

6. Assembly of claim 3 wherein the tail end is operatively attached to the pivotal force applying portion by a selectively axially weak attachment portion arranged for locally breaking the operative attachment of the tail end thereat upon applying an excessive axial pulling force thereon.

7. Assembly of claim 3 wherein the head end is operatively connected to the actuator by a selectively axially weak connecting means arranged for locally breaking the operative connection of the head end thereat upon applying an excessive axial pulling force thereon.

8. Tamper deactivating pivotal motion transmission assembly comprising a bearing member having an inward side and an outward side, and including a wall portion containing an open ended bore substantially concentric to an axis and extending through the member from one side to the other side of the member, and further including a hollow tube portion on the wall portion having a tube free end at the inward side of the member and projecting from the wall portion along the axis in a direction away from the outward side of the member, with the tube portion containing the bore as an open ended internal bore therethrough, an actuator containing an axial journal recess and operatively freely slidably mounted via the recess on the projecting tube free end and substantially concentric to the bore for pivotal movement about the axis at an axial activating position on the tube free end and for deviating axial movement from the axial activating position to a deactivating position off of the tube free end and out of operatively mounted relation therewith, a coil spring arranged in the recess substantially concentrically outwardly of the tube free end and axially operatively loaded between the actuator and the adjacent portion of the wall portion for resiliently urging the actuator off of the tube free end to the deactivating position, and a pivotal force transmitting shaft of substantially curved cross section having a head end extending through the tube bore and substantially axially operatively connected to the actuator for conjoint movement of the actuator and shaft relative to the member, the head end and tube free end substantially concentrically projecting into the recess, and the shaft also having a tail end at the outward side of the member and selectively remote from the actuator and member and arranged for attachment under tension at a corresponding remote reference point for maintaining the actuator at the axial activating position against the force of the coil spring and for receiving a pivotal force applied to the tail end at the reference point for pivoting the shaft and actuator, whereby upon disturbing the tension attachment disposition of tail end at or relative to the reference point the coil spring will urge the actuator to the deactivating position.

9. Assembly of claim 18 wherein the shaft is a flexible shaft which is locally flexibly displaceable from its normal longitudinal axis and when arranged under tension is substantially incapable of tortional twisting along its length in any position of local flexible displacement from its normal axis.

10. Assembly of claim 8 wherein a latch mechanism is provided which includes a reciprocally displaceably mounted release arm at the inward side of the member and adjacent to the axis and laterally of the tube free end to unlatch the latch mechanism, the release arm being disposed generally in a common plane with the actuator when at the axial activating position and which plane is substantially transverse to the axis, a lock mechanism is provided at a selectively remote reference point spaced from the latch mechanism and which includes a pivotal force applying portion, the actuator is operatively arranged on the tube free end at the axial activating position and laterally adjacent to the release arm and in the common plane therewith and selectively sized and shaped for coacting relation at the axial activating position with the release arm for actuating the release arm to unlatch the latch mechanism upon pivotal movement of the actuator about the axis, and also operatively arranged under the force of the coil spring for deviating axial movement out of coacting relation with the release arm when the actuator is urged to the deactivating position, and the head end is operatively connected to the actuator at the recess, and the tail end is operatively attached under tension to the pivotal force applying portion of the lock mechanism at the reference point for thereby maintaining the actuator at the axial activating position against the force of the coil spring and for thereby receiving a pivotal force applied to the tail end for pivoting the shaft and actuator for actuating the release arm to unlatch the latch mechanism, whereby upon disturbing the tension attachment disposition of the tail end at or relative to the lock mechanism the coil spring will urge the actuator to the deactivating position.

11. Assembly of claim 10 wherein the tail end is articulatedly attached to the pivotal force applying portion of the lock mechanism.

12. Assembly of claim 10 wherein the release arm is normally resiliently biased to an interfering position situated in at least a portion of the space which is otherwise normally occupied by the actuator when at the axial activating position, and the actuator is selectively sized and shaped relative to the release arm for engagingly displacing the release arm when the actuator is operatively mounted on the tube free end and disposed at the axial activating position, whereby upon movement of the actuator from the axial activating position to the deactivating position the release arm is biased into the interfering position to prevent the return of the actuator to the axial activating position.

13. Assembly of claim 10 wherein the tail end is operatively attached to the pivotal force applying portion by a selectively axially weak attachment portion arranged for locally breaking the operative attachment of the tail end thereat upon applying an excessive axial pulling force thereon.

14. Assembly of claim 10 wherein the head end is operatively connected to the actuator by a selectively axially weak connecting means arranged for locally breaking the operative connection of the head end thereat upon applying an excessive axial pulling force thereon.

15. Tamper deactivating pivotal motion transmission assembly comprising a latch mechanism, including a bearing member having an inward side and an outward side and a slide portion containing an open ended bore substantially concentric to an axis and extending through the member from one side to the other side of the member, and a release arm at the inward side of the member and adjacent to the axis to unlatch the latch mechanism, a lock mechanism at a selectively remote reference point spaced from the latch mechanism and including a pivotal force applying portion, an actuator operatively mounted on the slide portion substantially concentric to the bore at the inward side of the member for pivotal movement about the axis at an activating position thereon and selectively sized and shaped for coacting relation at the activating position with the release arm for actuating the release arm to unlatch the latch mechanism, and also operatively arranged for deviating movement from the activating position to a deactivating position out of operatively mounted relation with the slide portion and out of coacting relation with the release arm, resilient urging means operatively arranged between the actuator and latch mechanism for urging the actuator to the deactivating position, and a pivotal force transmitting linear shaft of substantially curved cross section and which is comprised as a flexible shaft which is locally flexibly displaceable from its normal longitudinal axis and when arranged under tension is substantially incapable of tortional twisting along its length in any position of local flexible displacement from its normal axis, the shaft having a head end substantially axially operatively connected to the actuator for pivotal movement of the actuator and shaft relative to the member upon applying a pivotal force to the shaft and for substantially axial movement of the shaft relative to the member in a direction from the outward side to the inward side of the member upon applying the urging force of the urging means to the actuator, and having a tail end at the outward side of the member and correspondingly remote from the actuator and member and attached under tension to the pivotal force applying portion of the lock mechanism at the reference point for thereby maintaining the actuator at the activating position against the force of the urging means and for thereby receiving a pivotal force applied to the tail end for pivoting the shaft and actuator to unlatch the latch mechanism, whereby upon disturbing the tension attachment disposition of the tail end at or relative to the lock mechanism the urging means will urge the actuator to the deactivating position.

16. Assembly of claim 15 wherein the tail end is articulatedly attached to the pivotal force applying portion of the lock mechanism.

17. Assembly of claim 15 wherein the release arm is reciprocally displaceably mounted and normally resiliently biased to an interfering position situated in at least a portion of the space which is otherwise normally occupied by the actuator when at the activating position, and the actuator is selectively sized and shaped relative to the release arm for engagingly displacing the release arm when the actuator is operatively mounted on the member and disposed at the activating position, whereby upon movement of the actuator from the activating position to the deactivating position the release arm is biased into the interfering position to prevent the return of the actuator to the activating position.

18. Assembly of claim 17 wherein the assembly is located in a motor vehicle for locking a compartment lid thereon, the motor vehicle correspondingly includes an exterior wall containing a lock opening and an interior wall spaced inwardly from the exterior wall, the lock mechanism is disposed in the lock opening at the exterior wall, the latch mechanism is disposed at the interior wall and includes a wall plate portion provided with the bearing member, the actuator has shaft connecting means for releasably selectively axially connecting the head end thereto, the tail end has an attachment portion arranged for releasably selectively attaching the shaft under tension to the pivotal force applying portion of the lock mechanism, and the urging means is arranged for urging the actuator away from the member to demount the actuator therefrom, whereby upon disturbing the tension attachment disposition of the tail end at or relative to the lock mechanism, such as by gaining access through the lock opening by prying the lock mechanism out from the vehicle exterior wall or by driving the lock mechanism inwardly through the vehicle exterior wall, the urging means will urge the actuator to demount the actuator from the member and prevent the unlatching of the latch mechanism and in turn the release arm will be displaced to the interfering position to prevent the remounting of the actuator on the member, whereas upon driving a tool through the vehicle exterior wall in an attempt to apply a tangential torque directly to the shaft to pivot the actuator for unlatching the latch mechanism, the flexible nature and curved cross section of the shaft will prevent such attempt from succeeding.

19. Assembly of claim 18 wherein the attachment portion of the tail end is provided as a selectively axially weak attachment portion arranged for locally breaking the operative attachment of the tail end thereat upon applying an excessive axial pulling force thereon.

20. Assembly of claim 18 wherein the shaft connecting means is provided as a selectively axially weak connecting means arranged for locally breaking the operative connection of the head end thereat upon applying an excessive axial pulling force thereon.

21. Assembly of claim 18 wherein the tail end is articulatedly attached to the pivotal force applying portion of the lock mechanism.

* * * * *

UNITED STATES PATENT AND TRADEMARK OFFICE

CERTIFICATE OF CORRECTION

PATENT NO. : 4,426,858

DATED : January 24, 1984

INVENTOR(S) : Bruno Interrante

It is certified that error appears in the above-identified patent and that said Letters Patent is hereby corrected as shown below:

Column 15, line 4, "and" should read -- an --.

Column 20, line 1, delete "in".

Column 23, line 36, "palce" should read --place--.

Column 26, line 21, "2b" should read -- 32b --.

Column 37, line 55, "claim 18" should read -- claim 8 --.

Signed and Sealed this

*Fourteenth* Day of *May 1985*

[SEAL]

*Attest:*

DONALD J. QUIGG

*Attesting Officer* *Acting Commissioner of Patents and Trademarks*